US005594542A

United States Patent [19]

Sugimoto et al.

[11] Patent Number: 5,594,542

[45] Date of Patent: Jan. 14, 1997

[54] IMAGE FORMING APPARATUS HAVING DOUBLE-SIDED IMAGE FORMING AND POST PROCESSING CAPABILITY

[75] Inventors: Yuji Sugimoto, Nara; Fujikazu Nakayama, Ikoma; Keizo Ito, Yamatokoriyama, all of Japan

[73] Assignee: Sharp Kabushiki Kaisha, Osaka, Japan

[21] Appl. No.: 513,612

[22] Filed: Aug. 10, 1995

[30] Foreign Application Priority Data

Sep. 13, 1994 [JP] Japan ..... 6-218817

[51] Int. Cl.[6] ..... G03G 21/00

[52] U.S. Cl. ..... 399/402; 271/3.02; 271/301

[58] Field of Search ..... 355/308, 309, 355/319, 324; 271/3.02, 3.03, 3.19, 163, 186, 301, 302

[56] References Cited

U.S. PATENT DOCUMENTS

| | | | |
|---|---|---|---|
| 4,772,917 | 9/1988 | Tani | 355/319 X |
| 5,216,474 | 6/1993 | Nakao | 355/319 |
| 5,298,959 | 3/1994 | Saito et al. | 355/319 |
| 5,450,188 | 9/1995 | Isobe | 355/308 X |

FOREIGN PATENT DOCUMENTS

| | | |
|---|---|---|
| 63-82237 | 4/1988 | Japan . |
| 1-29111 | 6/1989 | Japan . |
| 4-37425 | 6/1992 | Japan . |
| 4-301498 | 10/1992 | Japan . |
| 5-286281 | 11/1993 | Japan . |

*Primary Examiner*—William J. Royer
*Attorney, Agent, or Firm*—David G. Conlin; William J. Daley, Jr.

[57] ABSTRACT

A double-sided image forming apparatus includes a feed transport path which extends from a sheet cassette to an image forming section, a first discharge section, a second discharge section which is formed on a same side as side of the apparatus where the first discharge section is formed, a first transport path which extends from the image forming section to the first discharge section, a second transport path, which has a sheet insertion/discharge opening connected to a first discharge section side of the first transport path and which reverses a front and rear of a sheet transporting direction, a third transport path which connects the second transport path to the feed transport path, a fourth transport path which has a sheet insertion opening connected to the sheet insertion/discharge opening of the second transport path and a sheet discharge opening connected to the second discharge section, a jogger for adjusting sheets in the fourth transport path and sheets in the second transport path with a prescribed position, and a stapler for stapling the sheets in the fourth transport path. As a result, miniaturizing and lowering of costs of the apparatus can be realized in the double-sided image forming apparatus.

14 Claims, 19 Drawing Sheets

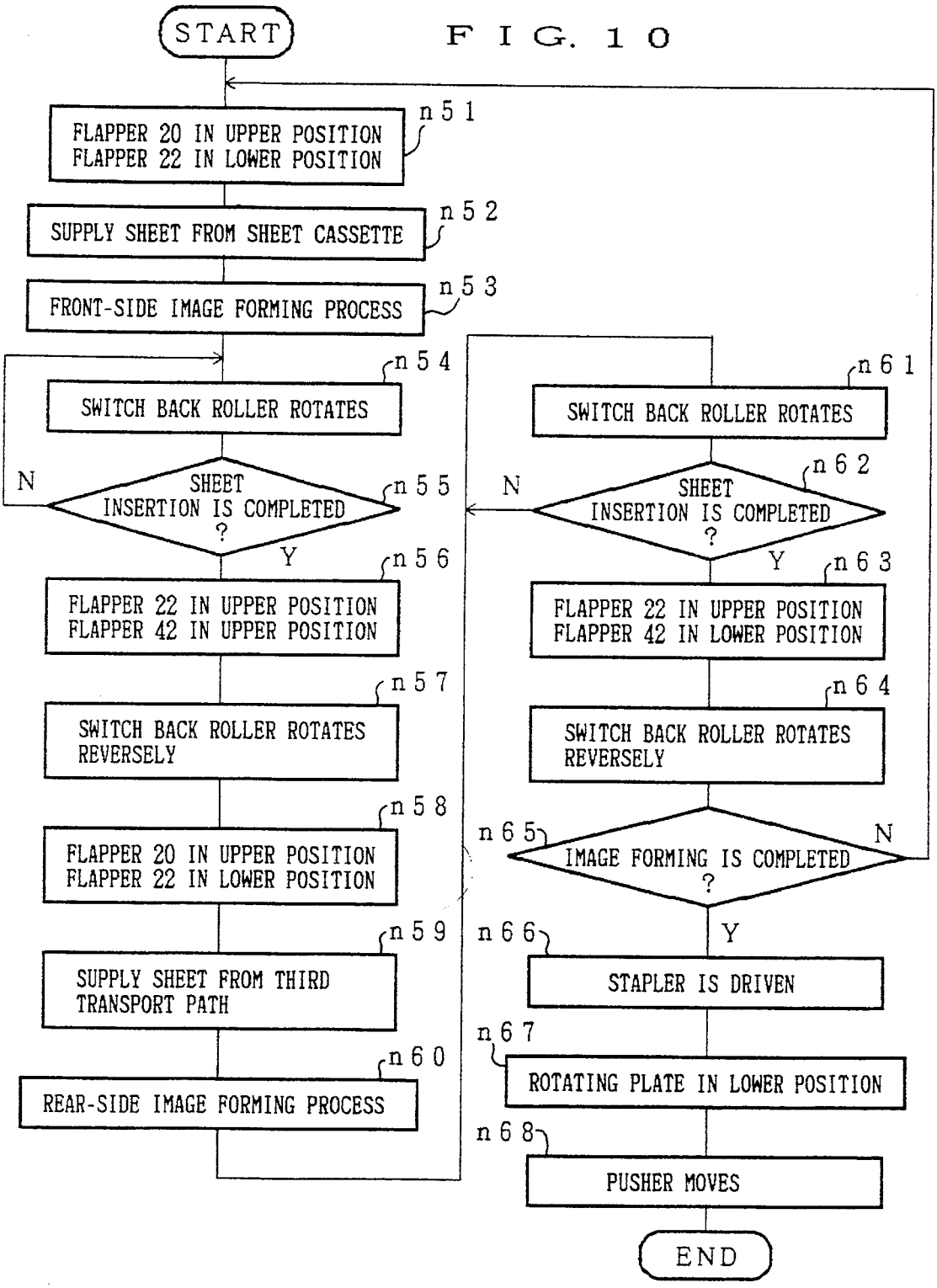
START
FIG. 10
FLAPPER 20 IN UPPER POSITION
FLAPPER 22 IN LOWER POSITION
n51
SUPPLY SHEET FROM SHEET CASSETTE
n52
FRONT-SIDE IMAGE FORMING PROCESS
n53
SWITCH BACK ROLLER ROTATES
n54
SHEET INSERTION IS COMPLETED ?
n55
N
Y
FLAPPER 22 IN UPPER POSITION
FLAPPER 42 IN UPPER POSITION
n56
SWITCH BACK ROLLER ROTATES REVERSELY
n57
FLAPPER 20 IN UPPER POSITION
FLAPPER 22 IN LOWER POSITION
n58
SUPPLY SHEET FROM THIRD TRANSPORT PATH
n59
REAR-SIDE IMAGE FORMING PROCESS
n60
SWITCH BACK ROLLER ROTATES
n61
SHEET INSERTION IS COMPLETED ?
n62
N
Y
FLAPPER 22 IN UPPER POSITION
FLAPPER 42 IN LOWER POSITION
n63
SWITCH BACK ROLLER ROTATES REVERSELY
n64
IMAGE FORMING IS COMPLETED ?
n65
N
Y
STAPLER IS DRIVEN
n66
ROTATING PLATE IN LOWER POSITION
n67
PUSHER MOVES
n68
END

| | | | | | |
|---|---|---|---|---|---|
| a | A | B | C | D | E |
| b | F | G | H | I | J |
| c | K | L | M | N | O |
| d | P | Q | R | S | T |
| e | U | V | W | X | Y |

| | | | | |
|---|---|---|---|---|
| U | P | K | F | A |
| V | Q | L | G | B |
| W | R | M | H | C |
| X | S | N | I | D |
| Y | T | O | J | E |

| | | | | |
|---|---|---|---|---|
| Y | X | W | V | U |
| T | S | R | Q | P |
| O | N | M | L | K |
| J | I | H | G | F |
| E | D | C | B | A |

| | | | | |
|---|---|---|---|---|
| E | J | O | T | Y |
| D | I | N | S | X |
| C | H | M | R | W |
| B | G | L | Q | V |
| A | F | K | P | U |

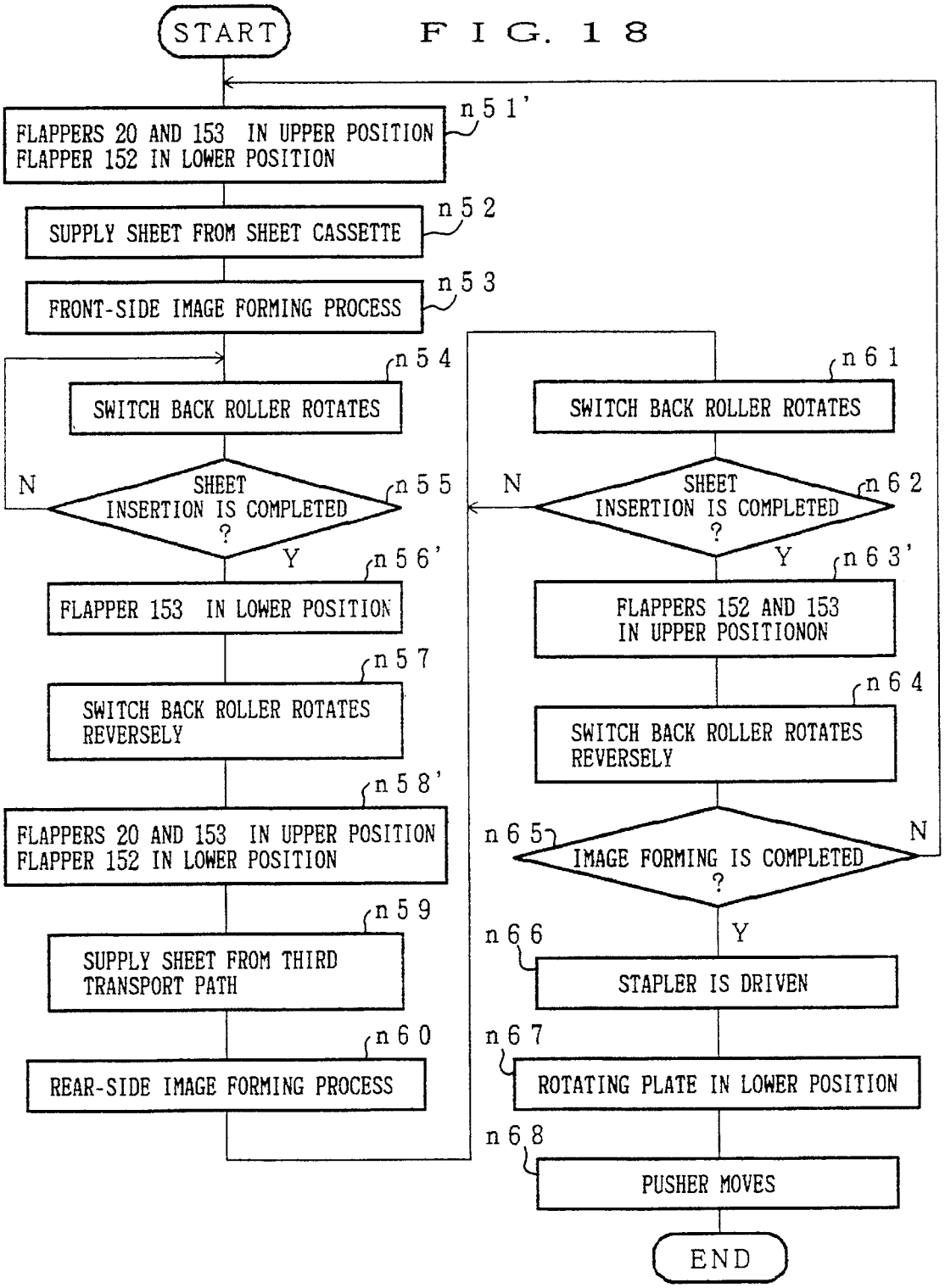
START
FIG. 18
FLAPPERS 20 AND 153 IN UPPER POSITION
FLAPPER 152 IN LOWER POSITION
n51'
SUPPLY SHEET FROM SHEET CASSETTE
n52
FRONT-SIDE IMAGE FORMING PROCESS
n53
SWITCH BACK ROLLER ROTATES
n54
SHEET INSERTION IS COMPLETED ?
n55
N
Y
FLAPPER 153 IN LOWER POSITION
n56'
SWITCH BACK ROLLER ROTATES REVERSELY
n57
FLAPPERS 20 AND 153 IN UPPER POSITION
FLAPPER 152 IN LOWER POSITION
n58'
SUPPLY SHEET FROM THIRD TRANSPORT PATH
n59
REAR-SIDE IMAGE FORMING PROCESS
n60
SWITCH BACK ROLLER ROTATES
n61
SHEET INSERTION IS COMPLETED ?
n62
N
Y
FLAPPERS 152 AND 153 IN UPPER POSITIONON
n63'
SWITCH BACK ROLLER ROTATES REVERSELY
n64
IMAGE FORMING IS COMPLETED ?
n65
N
Y
STAPLER IS DRIVEN
n66
ROTATING PLATE IN LOWER POSITION
n67
PUSHER MOVES
n68
END

IMAGE FORMING APPARATUS HAVING DOUBLE-SIDED IMAGE FORMING AND POST PROCESSING CAPABILITY

FIELD OF THE INVENTION

The present invention relates to an image forming apparatus, such as a copying apparatus having a sheet post-processing function for performing a post-process, such as a stapling process, on sheets where an image has been formed and a double-sided image forming function for forming an image on both sides of sheets.

BACKGROUND OF THE INVENTION

In an image forming apparatus, such as a copying apparatus, an intermediate tray is provided inside the apparatus and an image is formed on both sides of sheets by using the intermediate tray. In this image forming apparatus, after a sheet where the image forming process on one side is completed is temporarily stored in the intermediate tray, the sheet is again carried to an image forming section so that an image is formed on the other side of the sheet. Besides such an apparatus, there also exists an image forming apparatus having a post-processing unit, such as a stapler for stapling a plurality of sheets where images have been formed on one side or both sides.

The intermediate tray and the stapler, which are used for such a double-sided image forming process, requires common processes, such as a sheet adjusting process, a process for stacking a plurality of sheets. In this case, when the intermediate tray and the stapler are individually attached to the image forming apparatus as separate units, mechanisms for common processes are duplicated. As a result, the apparatus becomes large and the number of parts increases, thereby causing a rise in costs.

SUMMARY OF THE INVENTION

It is an object of the present invention to provide a double-sided image forming apparatus which is capable of miniaturizing the apparatus and lowering the costs of apparatus. It is another object of the present invention to provide a double-sided image forming apparatus which is capable of discharging post-processed sheets and post-unprocessed sheets to one side of the apparatus and preventing remaining of sheets.

In order to achieve the above objects, a double-sided image forming apparatus having a post-processing function of the present invention includes (1) a sheet storing section for storing and feeding sheets, (2) an image forming section for forming an image on sheets, (3) a feed transport path which extends from the sheet storing section to the image forming section, (4) a first discharge section for discharging sheets out of the apparatus which is opened on one side of the double-sided image forming apparatus, (5) a second discharge section for discharging sheets out of the apparatus which is opened on the same side where the first discharge section is formed, (6) a first transport path which extends from the image forming section to the first discharge section, (7) a second transport path for reversing a front and rear of a sheet transporting direction which includes a sheet insertion/discharge opening connected to a first discharge section side of the first transport path, (8) a third transport path having a sheet insertion opening and a sheet discharge opening, the sheet insertion opening being connected to the sheet insertion/discharge opening of the second transport path, the sheet discharge opening being connected to the feed transport path, (9) a fourth transport path having a sheet insertion opening and a sheet discharge opening, the sheet insertion opening being connected to the sheet insertion/discharge opening of the second transport path, the sheet discharge opening being connected to the second discharge section, (10) an adjusting means for adjusting sheets transported to the fourth transport path and sheets transported to the second transport path with a prescribed position, and (11) post-processing means for performing a post-process on image formed sheets which have been transported to the fourth transport path and have been adjusted by the adjusting means.

With the above arrangement, in the fourth transport path connected to the second discharge section, the post-process, such as a stapling process, is performed. A sheet adjusting process and sheet stacking for the post process in the fourth transport path, and a sheet adjusting process and sheet stacking in the second transport path which is used for reversing a front/rear direction of sheets at the time of double-sided image forming are carried out by common adjusting means. As a result, the double-sided image forming apparatus of the present invention requires only one adjusting means, so the apparatus can be miniaturized by decreasing space for arrangement of the adjusting means and costs of the apparatus can be lowered by decreasing the number of parts.

In addition, the second discharge section for discharging post-processed sheets is formed on the same side of the apparatus as the side where the first discharge section for discharging post-unprocessed sheets is formed. Therefore, the sheets, which have been subject to the post process by means of the post-processing means in the fourth transport path, are discharged to the same side as that where the post-unprocessed sheets are discharged. As a result, even in the case where an image forming process which performs the post-process on the sheets and an image forming process which does not perform the post-process on the sheets are continuously executed, there does not occur remaining of sheets. Moreover, in the case where a discharge tray is provided in the first and second discharge sections, these two discharge trays are projected in a same direction, so the image forming apparatus can be miniaturized comparing to the case where the discharge trays are projected in opposite directions.

For fuller understanding of the nature and advantages of the invention, reference should be made to the ensuing detailed description taken in conjunction with the accompanying drawings.

BRIEF DESCRIPTION OF THE DRAWINGS

FIG. 10 is a flow chart which shows a processing procedure in a double-sided image forming mode which performs the stapling process in the double-sided image forming apparatus.

FIG. 18 is a flow chart which shows a processing procedure in the double-sided image forming mode which performs the stapling process in the double-sided image forming apparatus shown in FIG. 14.

DESCRIPTION OF THE EMBODIMENTS

The following will discuss one embodiment of the present invention referring to FIGS. 1 through 13.

Figure 19:
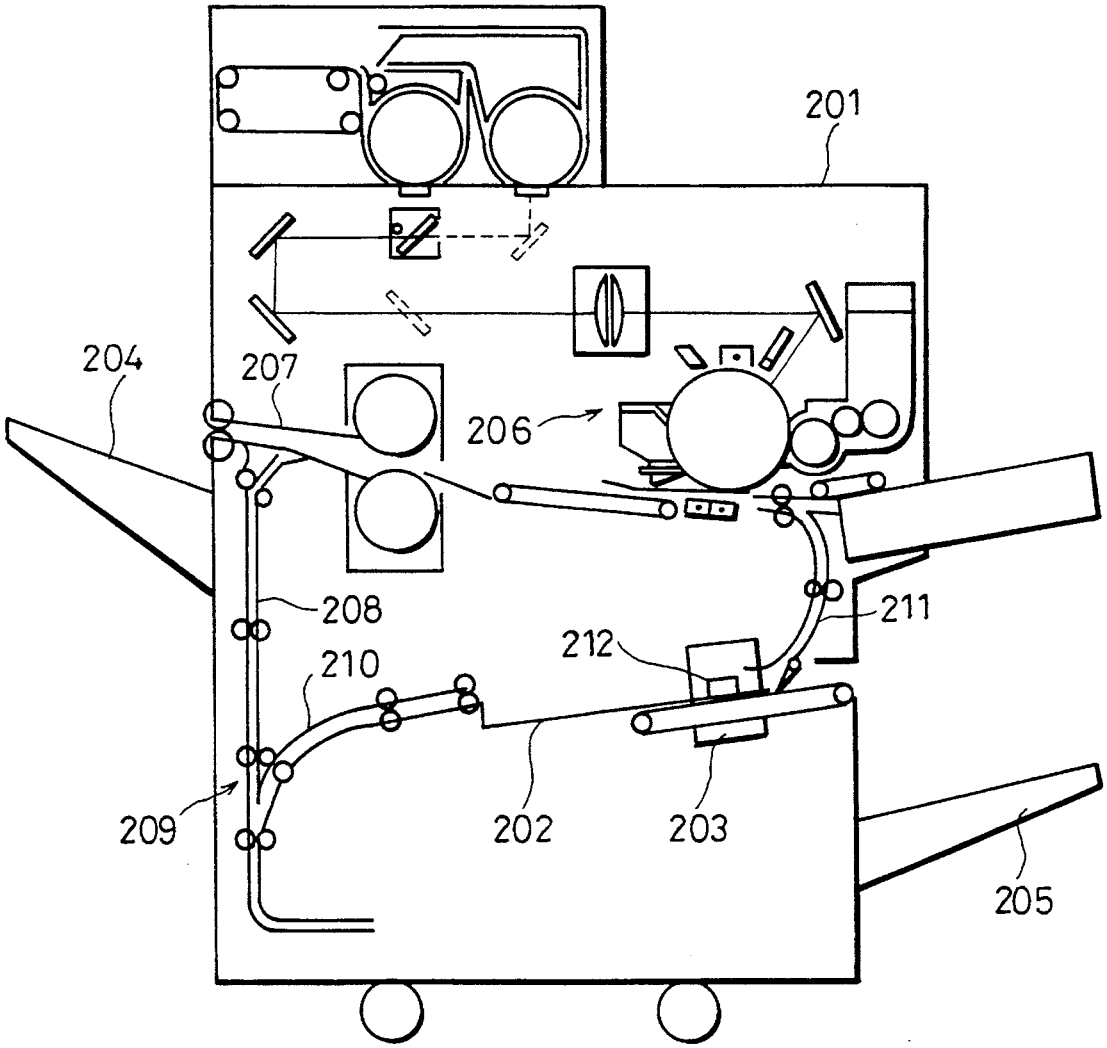
FIG. 19 (PRIOR ART)
FIG. 19 is a front view which shows an internal structure of a double-sided image forming apparatus which is a prerequisite for the double-sided image forming apparatus shown in FIG. 1.

First, a double-sided image forming apparatus which is a prerequisite for the present invention will be explained. The applicant of the present invention suggested an image forming apparatus 201 shown in FIG. 19 in Japanese Patent Application No. 4-94206/1992 (Tokuganhei 4-94206). The image forming apparatus 201 is provided with a stapler 203 in an intermediate tray 202 which is used for a double-sided image forming process. When an image is formed on one side of sheets in the image forming apparatus 201, sheets where an image has been formed on their one side by an image forming section 206 are discharged on a discharge tray 204 through a transport path 207. Moreover, at the time of forming an image on both sides of sheets, the sheets where an image has been formed on their one side by the image forming section 206 are transported to the intermediate tray 202 through the transport path 207, a transport path 208, a switch back transport path 209 and a transport path 210, and the sheets are adjusted with a prescribed position of the intermediate tray 202. Next, the sheets are again transported to the image forming section 206 through a transport path 211 and after an image is formed on opposite sides of the sheets, the sheets are discharged on the discharge tray 204. Moreover, during a stapling process, sheets on which an image has been formed are stored on the intermediate tray 202 and are adjusted by a jogger 212. Thereafter, the sheets are stapled by the stapler and are discharged on a discharge tray 205.

Since the above image forming apparatus 201 is provided with the stapler 203 in the intermediate tray 202, a mechanism for a sheet adjusting process and a mechanism for a sheet stacking process at the time of the stapling process and of the both-side image forming are one and the same. This makes it possible to miniaturize the image forming apparatus 201 by reducing an arrangement space and to realize lowering of costs by reducing the number of parts.

In addition, it is necessary for the stapling process that front and back sides of sheets are reversed according to a storing procedure and a storing direction of the sheets so that the sheets are stacked. Even in such a case, the image forming apparatus 201 can utilize reverse transport means which is indispensable to the both-side image forming process, namely, a reverse transport path 209 and the intermediate tray 202.

However, in the drawing, the image forming apparatus 201 is provided with the discharge tray 205 on a right side of the image forming apparatus 201 besides the discharge tray 204 provided on a left side of the image forming apparatus 201. The intermediate tray 202 having the stapler 203 is provided such that the right side of the image forming apparatus 201 is opened. The sheets, which have been subject to the stapling process on the intermediate tray 202, are discharged to the discharge tray 205 on the right side. For this reason, the sheets are discharged to both sides of the image forming apparatus 201. In other words, the discharge tray 204 and the discharge tray 205 are projected on one side and the other side of the image forming apparatus 201. Therefore, there's a limit in miniaturizing the apparatus.

Moreover, in the case where an image forming process accompanying the stapling process and an image forming process unaccompanying the stapling process are performed continuously, the sheets are discharged to the both sides of the apparatus, so there arises a problem that the sheets discharged to either of the sides of the apparatus are not taken.

Next, the following will discuss a double-sided image forming apparatus of one embodiment according to the present invention which can solve such a problem.

Figure 1:
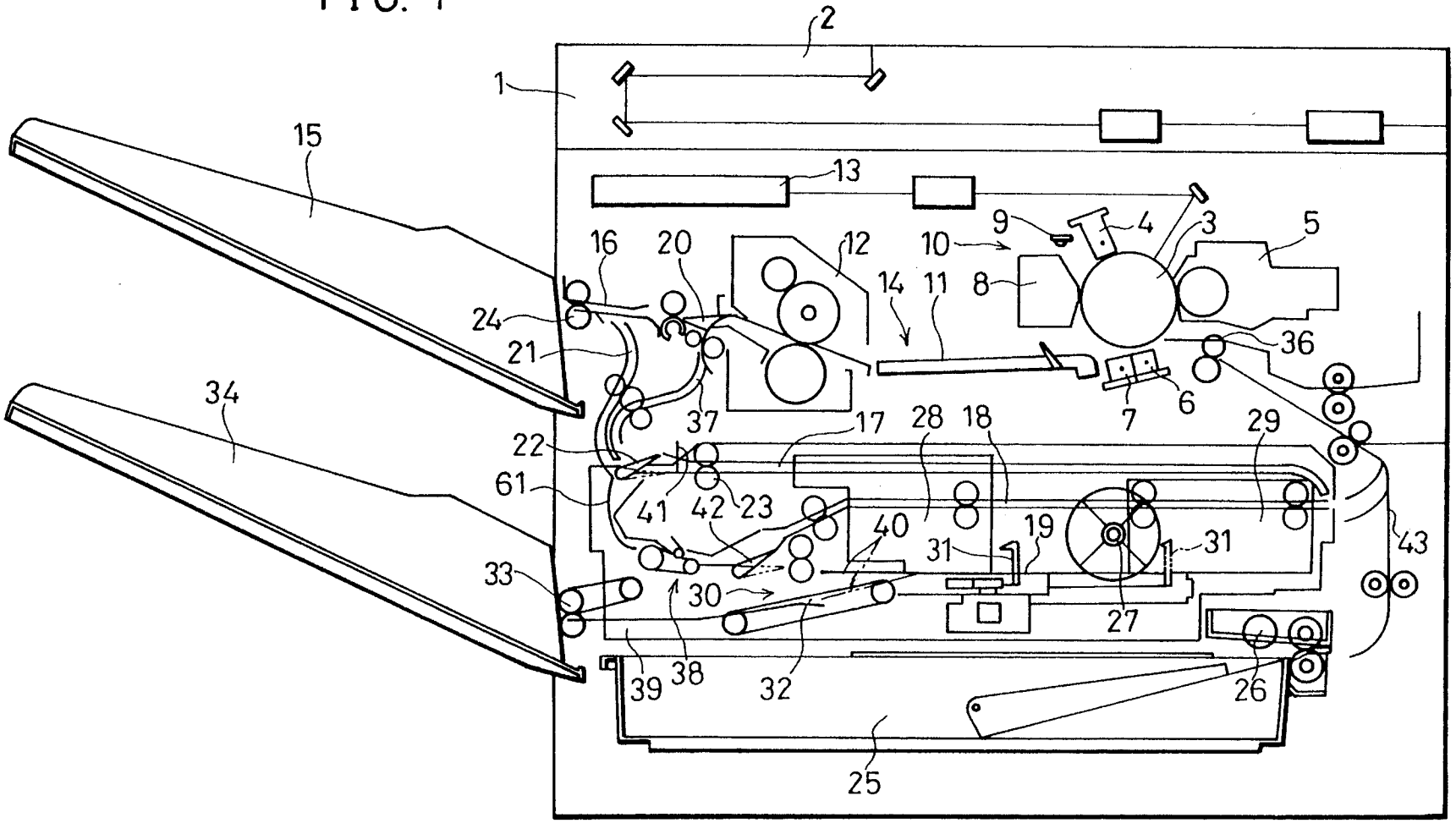
FIG. 1 is a front view which shows an internal structure of a double-sided image forming apparatus of one embodiment according to the present invention.

As shown in FIG. 1, an image forming apparatus 1 has an optical unit 2 on its upper side. The optical unit 2 reads an image of a document and converts its image information to digital data. A photoreceptor drum 3, a charger 4, a developing unit 5, a transfer charger 6, a peeling charger 7, a cleaning unit 8 and a charge eliminating lamp 9 which compose an image forming section 10 are provided inside the image forming apparatus 1. The charger 4, the developing unit 5, the transfer charger 6, the peeling charger 7, the cleaning unit 8 and the charge eliminating lamp 9 are positioned on a periphery of the photoreceptor drum 3. A transport belt 11 and a discharge roller 24 are provided from the image forming section through a fixing unit 12 to a discharge tray 15, and they compose a first transport path 14 including a discharge transport path 16. An end of the discharge roller 24 is a first discharge section which is provided on the side of the image forming apparatus 1 so that the side is opened.

A sheet cassette 25 is attached at the inner bottom of the image forming apparatus 1. The sheet cassette 25 houses a prescribed number of sheets, and it is detachable from a front side of the image forming apparatus 1. A feed transport path 43 is provided between the sheet cassette 25 and the image forming section 10 in an inner right part of the image forming apparatus 1. A PS roller 36 is provided to the feed transport path 43. The PS roller 36 synchronizes with a rotation of the photoreceptor drum 3 so as to lead sheets, which have been supplied from the sheet cassette 25 by a feeding roller 26, to the image forming section 10.

Figure 2:
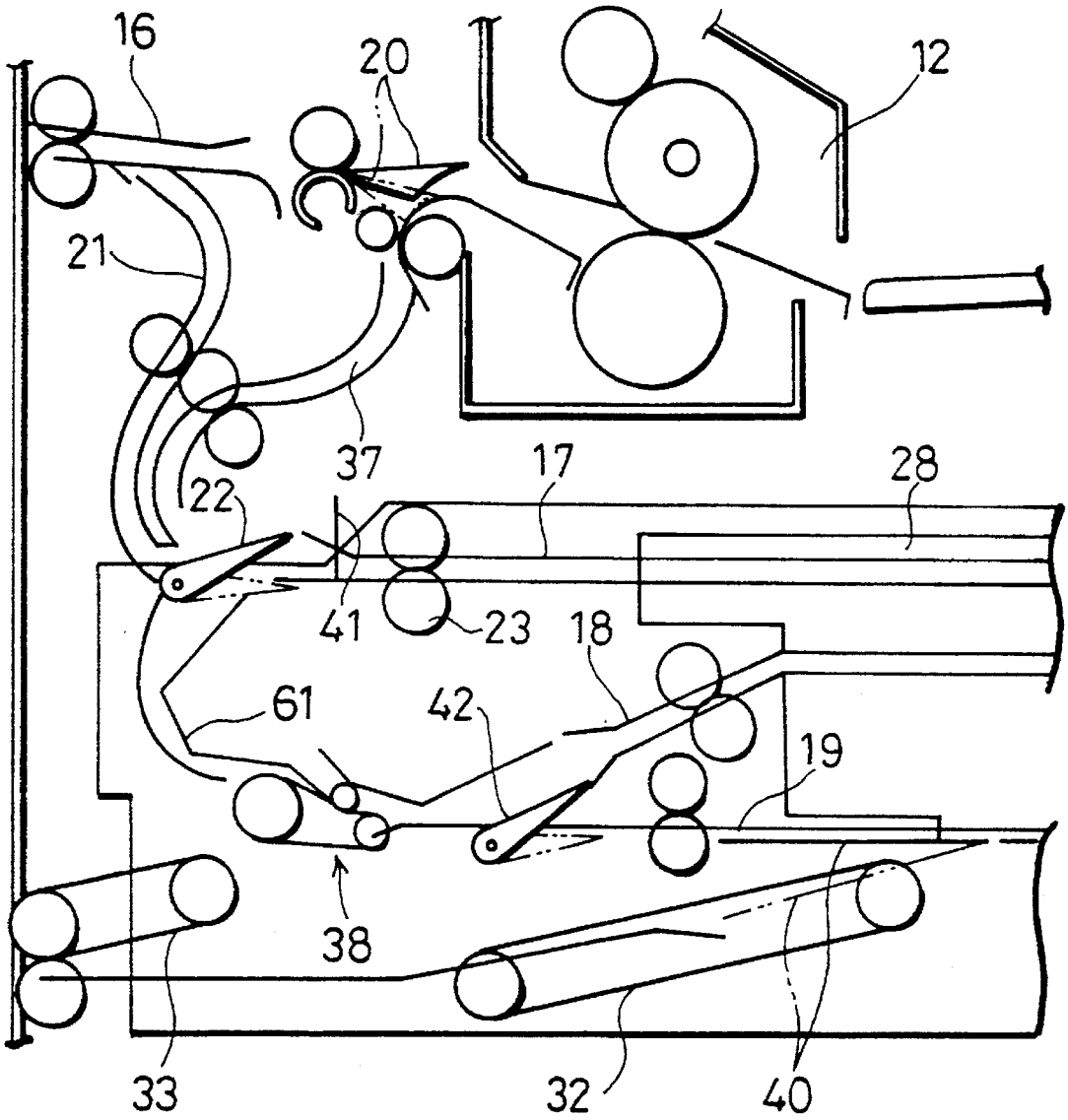
FIG. 2 is a enlarged drawing which shows a main part of the double-sided image forming apparatus shown in FIG. 1.

A second transport path 17, a third transport path 18 and a fourth transport path 19 are positioned between the first transport path 14 and the sheet cassette 25 such that they are laminated almost horizontally and parallel with one another. As shown in FIG. 2, a sheet insertion/discharge opening of the second transport path 17 is connected to the discharge transport path 16 side of the first transport path 14 through a passage 37 as a first connecting passage. A flapper 20 as first guiding means which freely rocks is provided to a section where the passage 37 and the first transport path 14 join. The flapper 20 selectively leads sheets which have passed the fixing unit 12 to the discharge transport path 16 or the passage 37. A switch back roller 23 is provided in a proximity of the sheet insertion/discharge opening of the second transport path 17. The switch back roller 23 rotates in one direction and in its reverse direction, and inverts a sheet transporting direction.

The third transport path 18 connects the sheet insertion/discharge opening of the second transport path 17 to the feed transport path 43. The fourth transport path 19 is provided with a sheet insertion opening which is connected to the sheet insertion/discharge opening of the second transport path 17. The fourth transport path 19 contains a paddler 27, a jogger 28, a stapler 29 and a pusher 31. The paddler 27 is provided with a plurality of flexible pressure plates on its circumferential surface, and it rotates counterclockwise so that a forward end of a sheet contacts with the pusher 31. The jogger 28 adjusts sheets with a prescribed position in a direction which intersects perpendicularly to the sheet transporting direction.

The sheet insertion/discharge opening of the second transport path 17 is connected to the discharge transport path 16 through a face down transport path 21 which is a fifth transport path. Moreover, the sheet insertion/discharge opening is connected to the sheet insertion openings of the third transport path 18 and the fourth transport path 19 through a passage 61 as a second connecting passage. The face down transport path 21 inverts front and back faces of a sheet on which an image has been formed so as to discharge it. The face down transport path 21 is provided to a position of the discharge tray 15 side with respect to the passage 37 such as to stretch in an up-and-down direction. This makes it possible to easily arrange the face down transport path 21 without enlarging of the apparatus.

A flapper 22 as second guiding means is provided between the face down transport path 21 and the sheet insertion/discharge openings of the second transport path 17. The flapper 22 leads sheets to be discharged from the second transport path 17 towards the face down transport path 21 or the third and fourth transport paths 18 and 19. Moreover, a flapper 42 as third guiding means is provided to the sheet insertion openings of the third transport path 18 and the fourth transport path 19. The flapper 42 leads sheets, which have been led downward thorough the second transport path 17 and the passage 61, to the third transport path 18 or the fourth transport path 19. A rotating plate 40 as a rocking member which freely rocks is provided in a midway position of the fourth transport path 19. The rotating plate 40 selectively connects the midway position of the fourth transport path 19 to the sheet insertion opening or a sixth transport path 30. When the rotating plate 40 rocks downward, the midway position of the fourth transport path 19 is connected to the transport belt 32 which constitute the sixth transport path 30. The sixth transport path 30 is arranged between the midway position of the fourth transport path 19 and a discharge tray 34, and a discharge belt 33 is provided in a proximity of the discharge tray 34. An end section of the discharge belt 33 is a second discharge section which is opened to a side of the image forming apparatus 1. The rotating plate 40 can discharge a sheet which has been subject to a post-process, namely, a stapling process in an upper space of the sheet cassette 25. Therefore, the provision of the rotating plate 40 prevents enlargement of the apparatus.

Here, a charge eliminating member 41 is provided to the sheet insertion/discharge opening of the second transport path 17. The charge eliminating member 41 contacts with a sheet so as to eliminate charges from the sheet at the time of inserting and discharging the sheet in and from the second transport path 17. Moreover, a straightening member 38 is provided in a proximity of the sheet insertion openings of the third transport path 18 and the fourth transport path 19. The straightening member 38 straightens curl of a sheet, which has been caused when the sheet has passed the fixing unit 12, etc.

Figure 3:
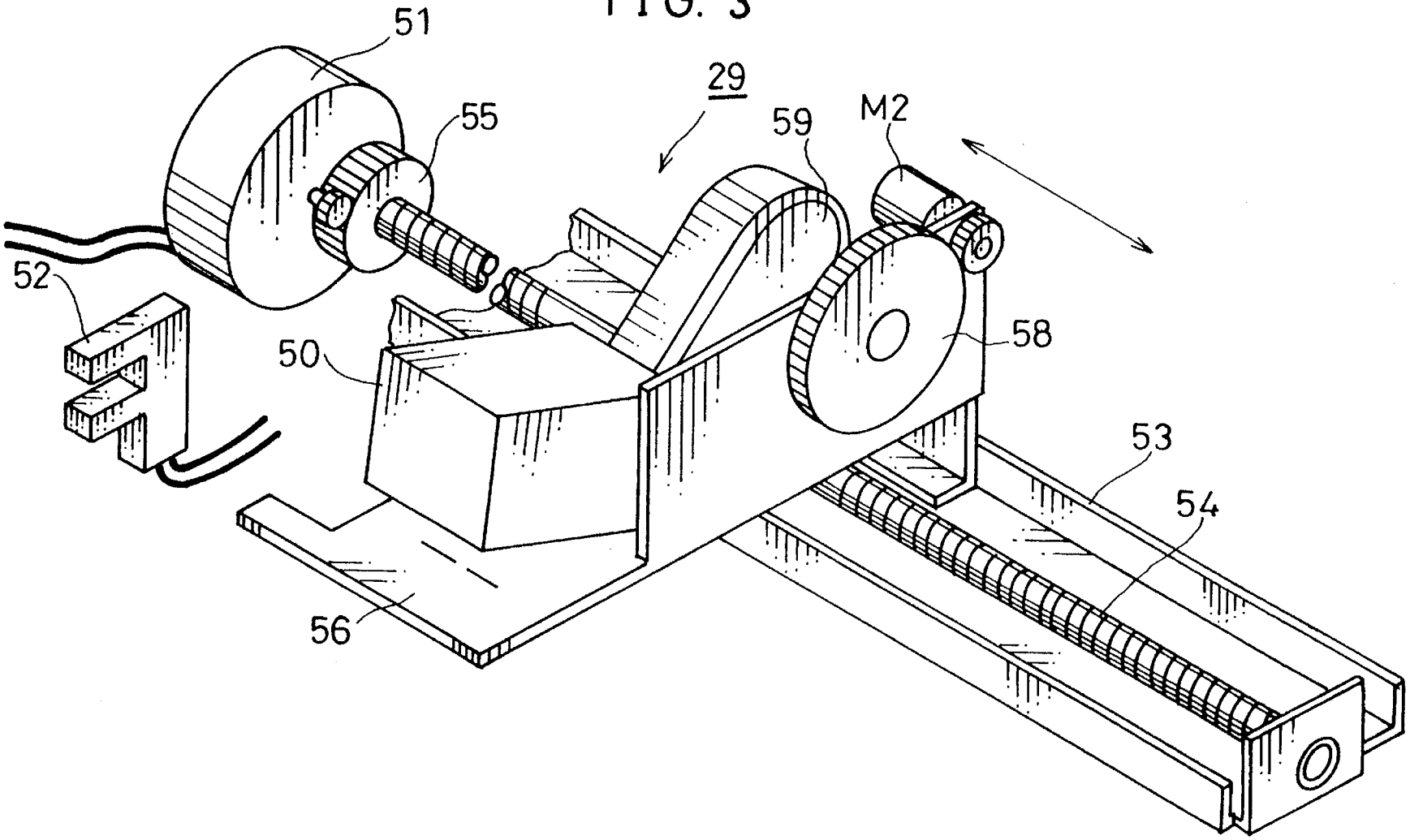
FIG. 3 is a perspective view which shows a stapler provided in the double-sided image forming apparatus.

FIG. 3 is a drawing of an appearance of a stapler as post-processing means which is provided to the image forming apparatus. The stapler 29 is composed of a stapler main body 50 containing staples, a driving table 56, a motor M2, a gear 58 and a rocking system 59. The main body 50 contains a plate which drives staples into sheets, and the plate rocks in an up-and-down direction with respect to the main body 50. Moreover, the main body 50 freely rocks perpendicularly with respect to the driving table 56. The rocking system 59 makes the plate rock with respect to the main body 50 and makes the main body 50 with respect to the driving table 56. The rocking system 59 receives a supply of driving force from the motor M2 through the gear 58. A feed screw 54 is screwed in a lower face of the stapler 29, and it contacts with a guide 53. Rotation of a motor 51 is supplied to the feed screw 54 through a gear 55. The stapler 29 moves back and forth along a guide 53 in a direction which intersects perpendicularly to the sheet transporting direction by rotation of the feed screw 54. The stapler 29 in a home position is detected by a sensor 52 which is opposite to a portion of the driving table 56.

Figure 4:
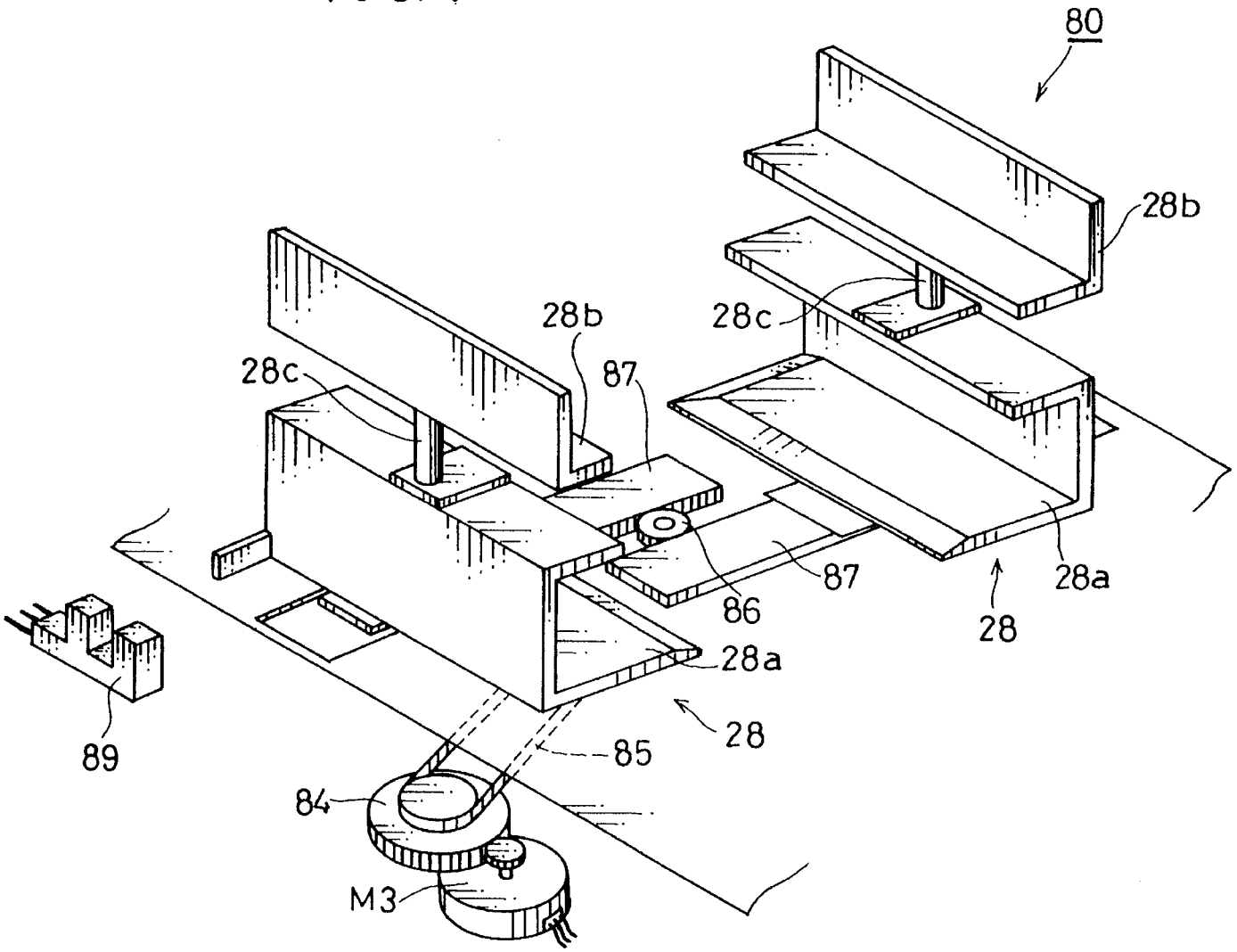
FIG. 4 is a perspective view which shows an adjusting unit provided in the double-sided image forming apparatus.

FIG. 4 is a drawing of appearance of an adjusting unit 80 as adjusting means provided to the image forming apparatus. The adjusting unit 80 includes a pair of joggers 28.28 which are opposite to each other. The joggers 28.28 are arranged such that a lower side member 28*a* and an upper side member 28*b* are connected in up-and-down direction by a connecting section 28*c*. A rack 87 is fixed to bottom surfaces of the joggers 28.28, and a pinion 86 is engaged with the rack 87. Rotation of a motor M3 is transmitted to the pinion 86 through a gear 84 and a belt 85. Moreover, home positions of the joggers 28.28 are detected by a sensor 89.

The lower side member 28*a* of the jogger 28 contacts with a side which is parallel to the transporting direction of sheets stored in the fourth transport path 19. The upper side member 28*b* contacts with a side which is parallel to the transporting direction of sheets stored in the second transport path 17. Since the fourth transport path 19 and the second transport path 17 are substantially parallel to each other, the lower side member 28*a* and the upper side member 28*b* are provided so as to be substantially parallel to each other. The connecting section 28*c* is a portion which is opposite to the third transport path 18. In order to make an exposure range of the third transport path 18 which does not require an adjusting process as small as possible, a width of the transporting direction of the third transport path 18 is made narrow. Here, the joggers 28.28 move in a direction which intersects perpendicularly to the sheet transporting direction whenever sheets do not pass through the third transport path 18.

Figure 5:
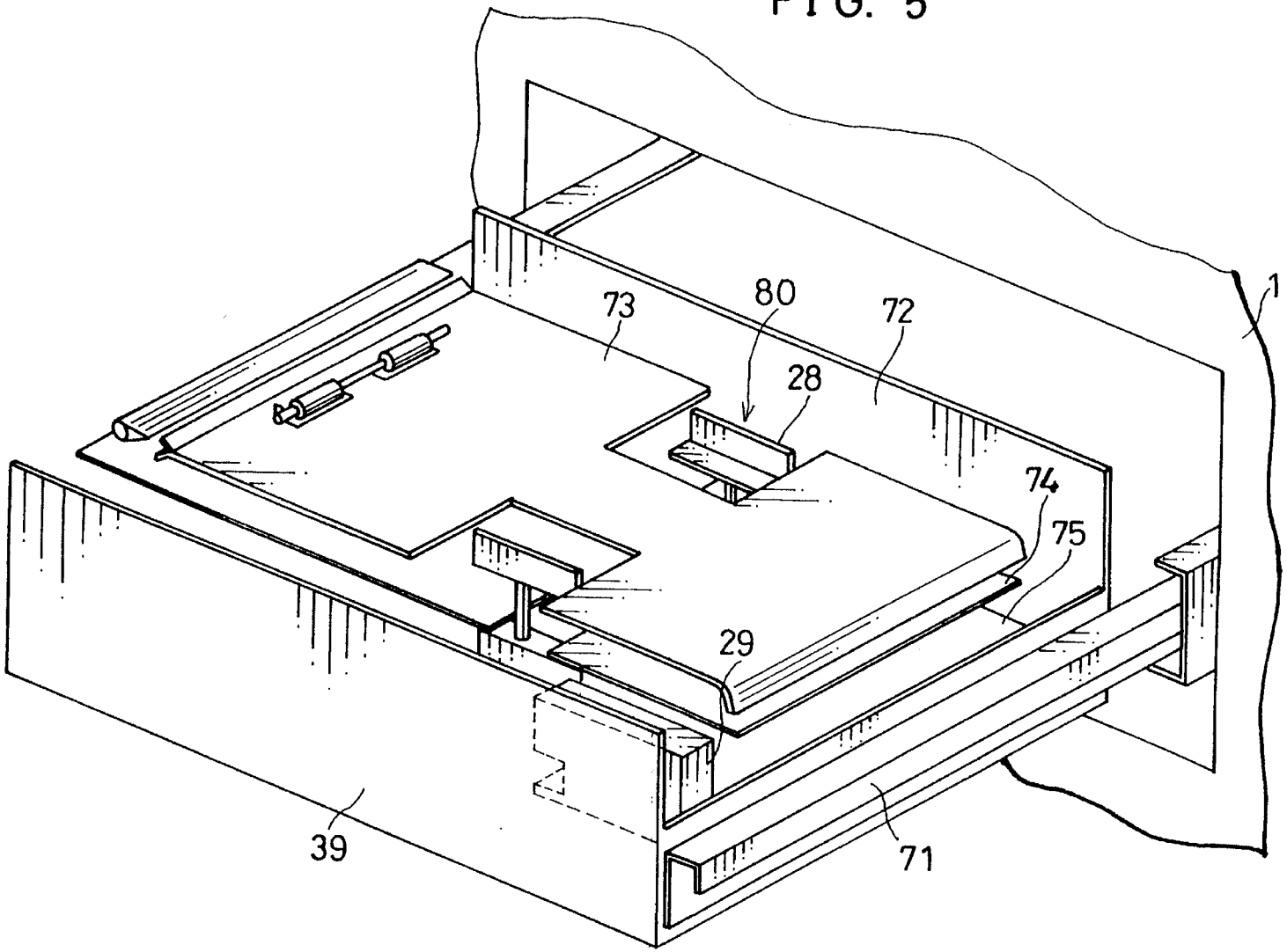
FIG. 5 is a perspective view which shows a transporting path unit provided in the double-sided image forming apparatus.

FIG. 5 is a drawing of appearance which shows a transport unit 39 of the image forming apparatus. A transport guide 73 composing the second transport path 17, a transport guide 74 composing the third transport path 18 and a transport guide 75 composing of the fourth transport path 19 are mounted in a backup member 72 together with an adjusting unit 80 including the jogger 28 and the stapler 29, and they compose a transport unit 39. The transport unit 39 is freely taken in and out of the image forming apparatus 1 from a front of the image forming apparatus by means of a rail member 71. As a result, removal of jam of sheets from each transport path, and maintenance and check, such as supply of staples to the stapler 29 can be easily performed with each transport path, the stapler 29, etc. exposed to the outside of the apparatus.

Figure 6:
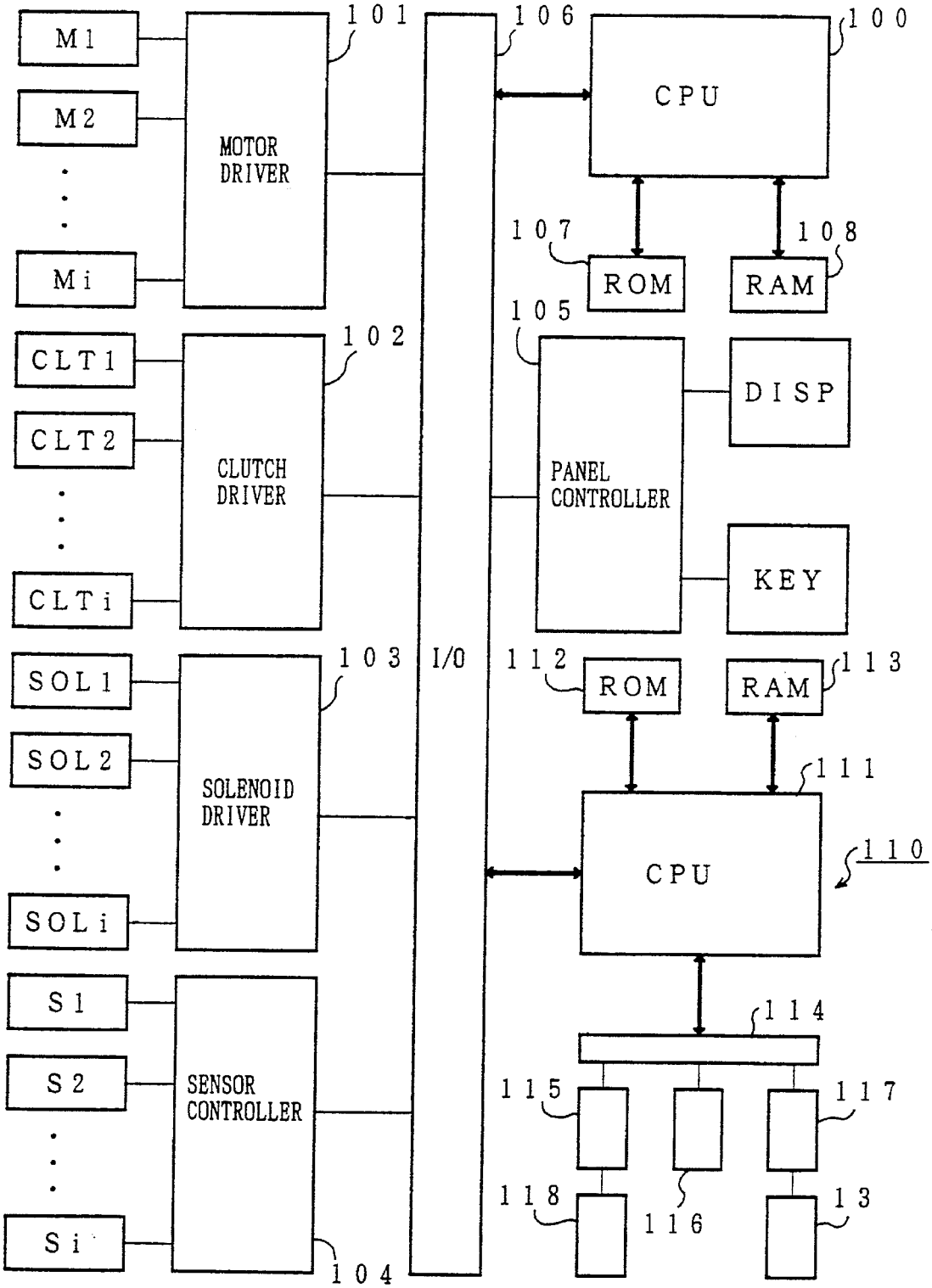
FIG. 6 is a block diagram which shows an arrangement of a control section of the double-sided image forming apparatus shown in FIG. 1.

FIG. 6 is a block diagram which shows an arrangement of a control section 110 of the image forming apparatus. The control section 110 of the image forming apparatus is arranged such that a motor driver 101, a clutch driver 102, a solenoid driver 103, a sensor controller 104, a panel controller 105 and a CPU 111 of the control section 110 of an optical unit 2 are connected to a CPU 100 including a ROM 107 and a RAM 108 through an interface 106. The CPU 100 generally controls each I/O equipment according to programs which have been previously written to the ROM 107 and puts data to be inputted/outputted in a prescribed memory area of the RAM 108.

The motor driver 101 drives each motor provided in the image forming apparatus 1 according to driving data to be outputted from the CPU 100. The motor M1 for driving the photoreceptor drum 3 in the image forming section 10, the motor M2 provided in the stapler 29, the motor M3 provided in the adjusting unit 80, etc. are connected to the motor driver 101.

A plurality of clutches are connected to the clutch driver 102, and the clutch driver 102 drives each clutch according to driving data outputted from the CPU 100. The clutches connected to the clutch driver 102 selectively transmits rotation of the motor M1 to rollers provided in each transport path.

A plurality of solenoids are connected to the solenoid driver 103, and the solenoid driver 103 drives the solenoids according to driving data outputted from the CPU 100. The solenoids connected to the solenoid driver 103 actuates the flappers 20, 22 and 42, etc.

A plurality of sensors are connected to the sensor controller 104. These sensors includes a sensor for detecting a sheet in a prescribed position of each transport path, a sensor for detecting temperature of a fixing roller of the fixing unit 12, etc. Data detected by these sensors are inputted to the CPU 100 through the sensor controller 104.

A display unit and a keyboard which compose an operation panel are connected to the panel controller 105. The panel controller 105 drives each display unit according to display data outputted from the CPU 100 and sends operation data on the keyboard to the CPU 100.

The CPU 100 is connected to a CPU 111 which composes a control section 110 of the optical unit 2. The control section 110 of the optical unit 2 is arranged such that an image data input section 115, an image processing section 116 and an image data output section 117 are connected to the CPU 111 having a ROM 112 and a RAM 113 through an interface 114.

The image data input section 115 binarizes image data of a document which have been read by a CCD 118 of the optical unit 2 and processes the image data using an error diffusion method while taking a histogram as digital data. In other words, the CCD 118 outputs an analog electrical signal according to each picture element mode of the image data. After the analog electrical signal is converted into a digital electrical signal, the digital electrical signal is compensated by MTF compensation, black/white compensation or gamma correction so as to be outputted to a histogram processing section as a digital signal with tone of 256 (8 bits). The histogram processing section creates density information from the digital signal and supplies the density information as picture element data to an error diffusion processing section. The error diffusion processing section converts the digital signal of 8 bits/picture element into 1 bit (binary digit) using the error diffusion method which is a kind of a pseudo-intermediate tone process, namely, a method for reflecting a binarization error in judgement about binarization of adjoining picture elements, and calculates relocation of the data in order to faithfully reproduce density of a local area.

The image processing section 116 is a processing section for converting image data to desired image data, and it writes output image data which have been finally converted to the RAM 113. In other words, the data which have been binarized in the error diffusion processing section are again converted into data with tone of 256 in a multivalued section, and in a synthesizing section, logical operations per a picture element, namely, OR, AND, or exclusive-OR operation are selectively performed. The image data output section 117 supplies output image data stored in the RAM 113 to the laser unit 13. At this time, the image data is reconstructed and an error diffusion method is applied to 4-valued data as necessary.

In such a way, in a so-called digital image forming apparatus for storing a document image as image data, image data which have been once read are repeatedly outputted so that an image forming process can be performed. For this reason, in a double-sided multi-image forming mode for forming a copying image of each double-sided document on a plurality of sheets, it is not necessary that a prescribed number of sheets where an image has been formed on their one surface are stored in the intermediate tray. Therefore, it is not necessary to provide the intermediate tray to the digital image forming apparatus. On the contrary, in a so-called analog image forming apparatus in which a photoreceptor is exposed by a reflected light from a document image, in order to omit repetition of operations for switching a front face and a rear face of a document, the intermediate tray for storing a prescribed number of sheets where an image has been formed on their one surface is required.

FIGS. 7 through 10 are flow charts which show a main part of a processing procedure at the time of image forming by the image forming apparatus having the above arrangement.

Figure 7:
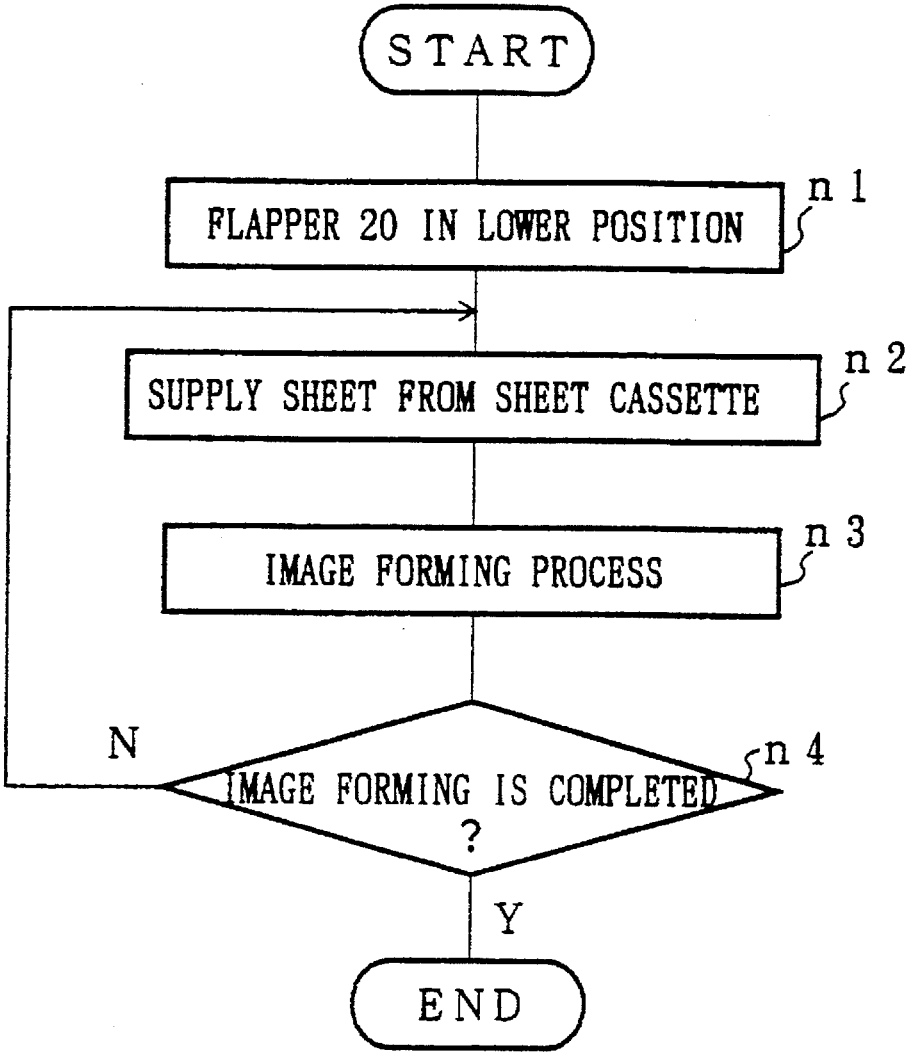
FIG. 7 is a flow chart which shows a processing procedure in a one-sided image forming mode which does not perform a stapling process in the double-sided image forming apparatus.

As shown in FIG. 7, in the one-sided image forming mode which does not perform the stapling process, the flapper 20 is moved downward and a passage from the first transport path 14 to the discharge transport path 16 is opened (n1) so that an image is formed on a sheet which has been supplied from the sheet cassette 25 through the feed transport path 43 (n2, n3). At the time of this image forming, the laser unit 13 is driven according to image data read by the optical unit 2, and an electrostatic latent image is formed on a surface of the photoreceptor drum 3 by a laser beam emitted from the laser unit 13. The electrostatic latent image is developed by the developing unit 5 so that a visible image is formed by toner. A formed toner image is transferred on a sheet by the transfer charger 6. The sheet on which the toner image has been transferred is led to the fixing unit 12 by the transport belt 11. The fixing unit 12 makes the toner on the sheet melt and fixes it. As mentioned above, the flapper 20 has moved downward, so the one-side image formed sheet which has passed the fixing unit 12 is discharged on the discharge tray 15 through the discharge transport path 16.

Thereafter, the image forming apparatus repeats the sequences n2 and n3 until the image forming is completed (n41). When the image forming is completed, the image forming apparatus ends the operation.

Figure 8:
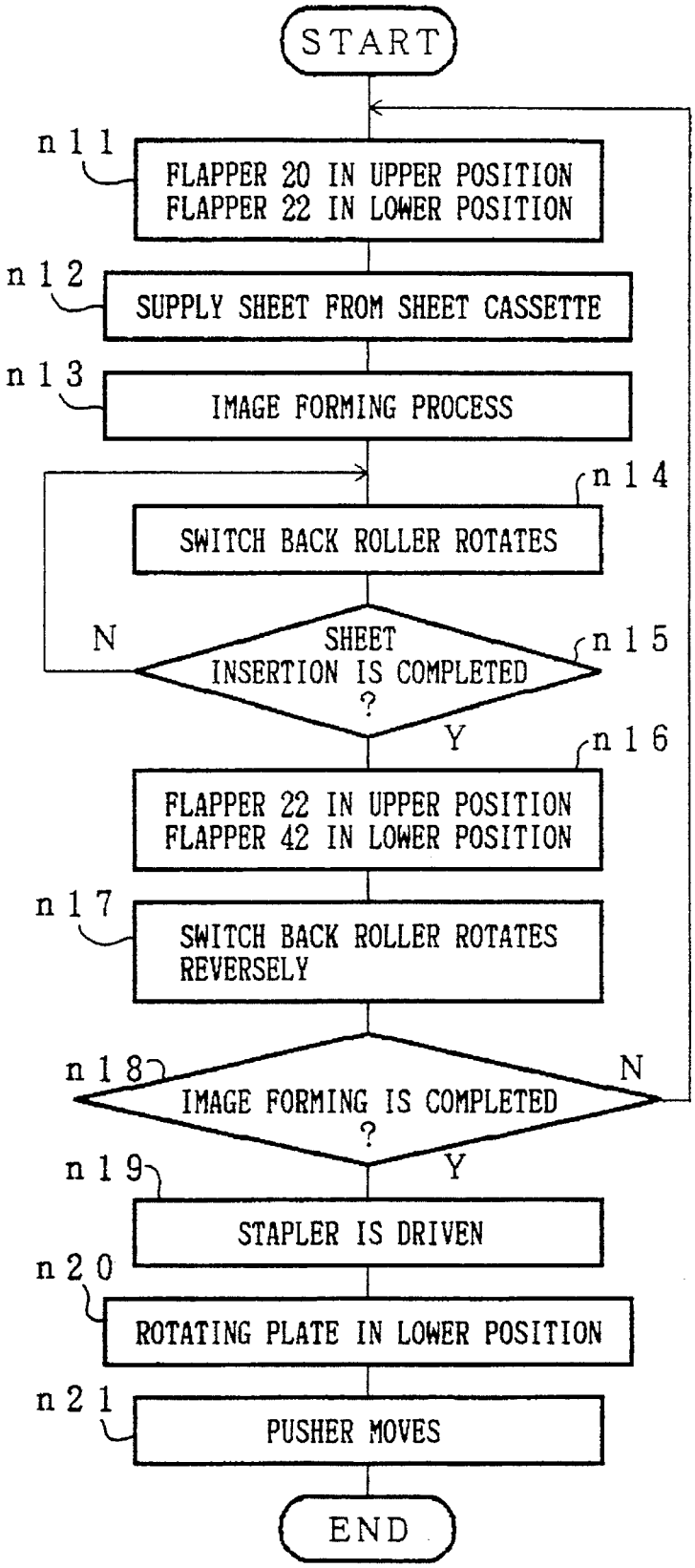
FIG. 8 is a flow chart which shows a processing procedure in a one-sided image forming mode which performs the stapling process in the double-sided image forming apparatus.

As shown in FIG. 8, in the one-sided image forming mode which performs the stapling process, the flapper 20 moves upward and the flapper 22 moves downward so that a sheet which has been supplied from the sheet cassette 25 through the feed transport path 43 is subject to the image forming process (n11 through n13). As a result, the sheet which has passed the fixing unit 12 passes through the passage 37 so as to be led to the second transport path 17. At this time, the switch back roller 23 rotates in a direction where sheets are led to and/or from the sheet insertion/discharge opening into the second transport path 17, and the sheet is led into the second transport path 17 from the sheet insertion/discharge opening (n14, n15). When a backward end of the sheet passes the sheet insertion/discharge opening of the second transport path 17, the switch back roller 23 stops rotating and its pressing is released. Then, a position of a widthwise direction of the sheets are adjusted by the jogger 28.

Successively, the flapper 22 moves upward and the flapper 42 moves downward (n16). The switch back roller 23 is again pressed against the sheet and it rotates reversely (n17). As a result, the sheet is discharged from the second transport path 17 and is led into the fourth transport path 19 through the straightening member 38. In the fourth transport path 19, the sheet is pushed towards the pusher 31 by the paddler 27, and the sheet is positioned in the transporting direction by making a forward end of the sheet contact with pusher 31. Moreover, the sheet is positioned in a direction which intersects perpendicularly the sheet transporting direction by the jogger 28.

In such a way, in the one-sided image forming mode which performs the stapling process, all the sheets on which the image forming has been completed are stored in the fourth transport path 19 with them being adjusted. When the image forming of all document images is completed (n18), a plurality of sheets stored in the fourth transport path 19 are stapled in a prescribed position by the stapler 29 (n19). After the stapling process by the stapler 29 is completed, the rotating plate 40 moves downward, and the pusher 31 moves towards the sheet insertion/discharge opening of the fourth transport path 19 (n20, n21). As a result, a plurality of sheets which has been subject to the stapling process are led to the sixth transport path 30 by dead weight and are discharged on the discharge tray 34 by rotation of the transport belt 32 and the discharge belt 33. Here, setting of a position where the stapling process should be performed will be mentioned later.

Figure 9:
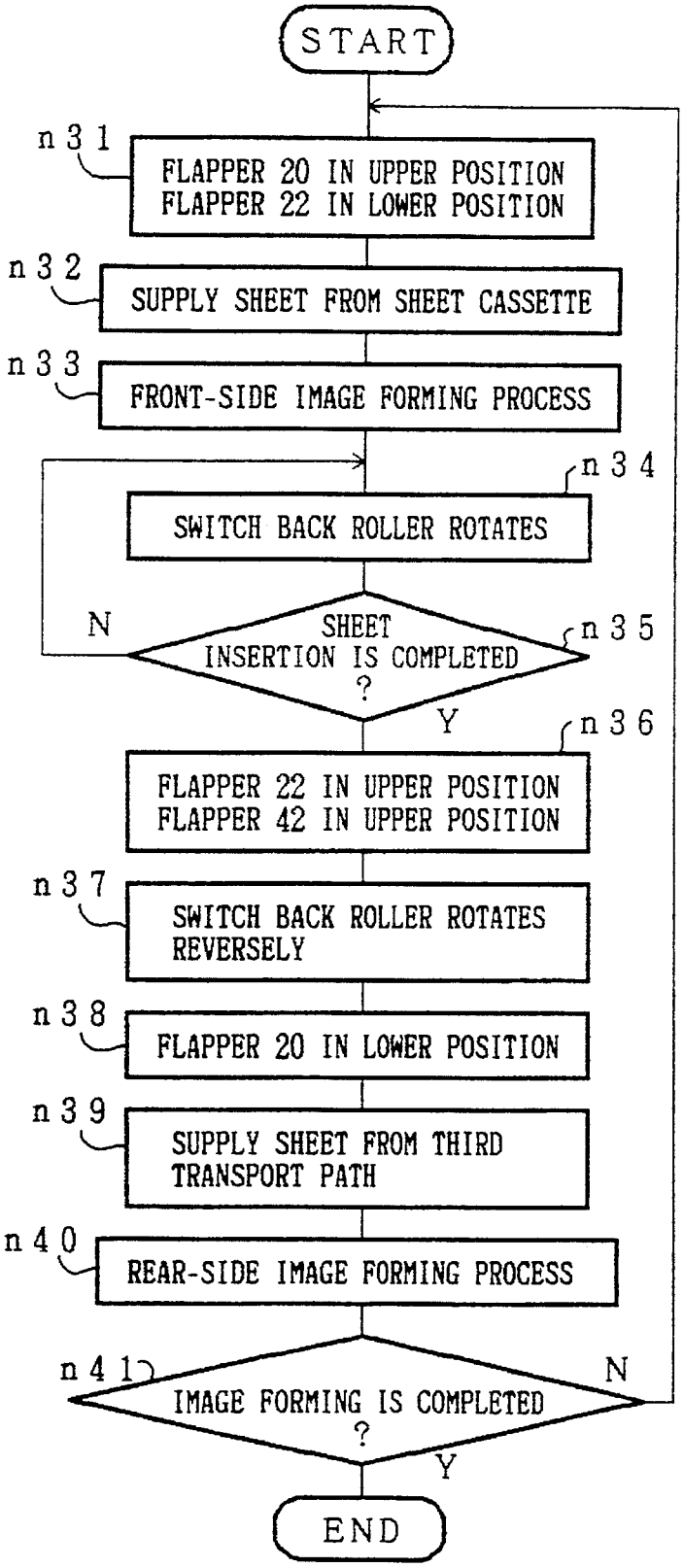
FIG. 9 is a flow chart which shows a processing procedure in a double-sided image forming mode which does not perform the stapling process in the double-sided image forming apparatus.

As shown in FIG. 9, in the double-sided image forming mode which does not perform the stapling process, sheets are supplied from the sheet cassette 25 with the flapper 20 upwards and the flapper 22 downwards (n31, n32). An image is formed on one side of the sheets in the image forming section 10 (n33), and the sheets are led to the fixing unit 12. The sheet which has passed the fixing unit 12 are led to the second transport path 17 through the passage 37 by action of the flapper 20 (n34, n35). While the one-sided image formed sheets are stored in the second transport path 17, the flapper 22 moves upwards and the flapper 42 also moves upwards (n36). In this state, the switch back roller 23 rotates reversely (n37), and the one-sided image formed sheets stored in the second transport path 17 are led to the third transport path 18 with its front and back of the sheet transporting direction reversed. The one-sided image formed sheets led into the third transport path reach the PS roller 36 through the feed transport path 43 and are led to the image forming section 10 at prescribed intervals (n39, n40). At this time, surfaces of the sheets where the image has not been formed are counter to the photoreceptor drum 3. The flapper 20 moves downward by the time when the sheets pass the fixing unit 12 (n38), and the sheets are discharged to the discharge tray 15 from the discharge transport path 16.

Thereafter, the image forming apparatus repeats the sequences n31 and n40 until the image forming is completed (n4). When the image forming is completed, the image forming apparatus ends the operation.

As shown in FIG. 10, in the double-sided image forming mode accompanying the stapling process, in the similar manner to in the double-sided image forming mode unaccompanying the stapling process, after the one-sided image formed sheets are led to the third transport path 18 so that an image is formed on the both sides of the sheets, the double-sided image formed sheets are transported to the second transport path 17 with the flapper 20 upward and the flapper 22 downward (n51 through n62). Thereafter, the switch back roller 23 rotates reversely with the flapper 22 upward and the flapper 42 downward (n63, n64), and the double-sided image formed sheets are stored in the fourth transport path 19. In the fourth transport path 19, in the same manner as in the one-sided image forming mode accompanying the stapling process, the double-sided image formed sheets are adjusted by the paddler 27, the jogger 28 and the pusher 31 so as to be in a proper storing position.

In this way, after the double-sided image formed sheets are successively stored in the fourth transport path 19 and the forming of all the images is completed, a plurality of the double-sided image formed sheets are stapled by the stapler 29 (n65, n66). Thereafter, the rotating plate 40 moves downward (n67), and the plural double-sided image formed sheets which has been stapled are led to the sixth transport path 30 by movement of the pusher 31 (n68) so as to be discharged on the discharge tray 34 by rotation of the transport belt 32 and the discharge belt 33.

For convenience of an adjusting process of the plural image formed sheets, at the time of the image forming accompanying a face down process for inverting the image formed surface of the sheets and discharging the sheets, the flapper 20 moves upward and the flapper 22 moves downward, and the image formed sheets which have passed the fixing unit 12 are led to the transport path 17. After the image formed sheets are stored in the second transport path 17, the flapper 22 moves downward and the switch back roller 23 rotates reversely so that the image formed sheets stored in the second transport path 17 are discharged on the discharge tray 15 through the face down transport path 21.

Figure 11:
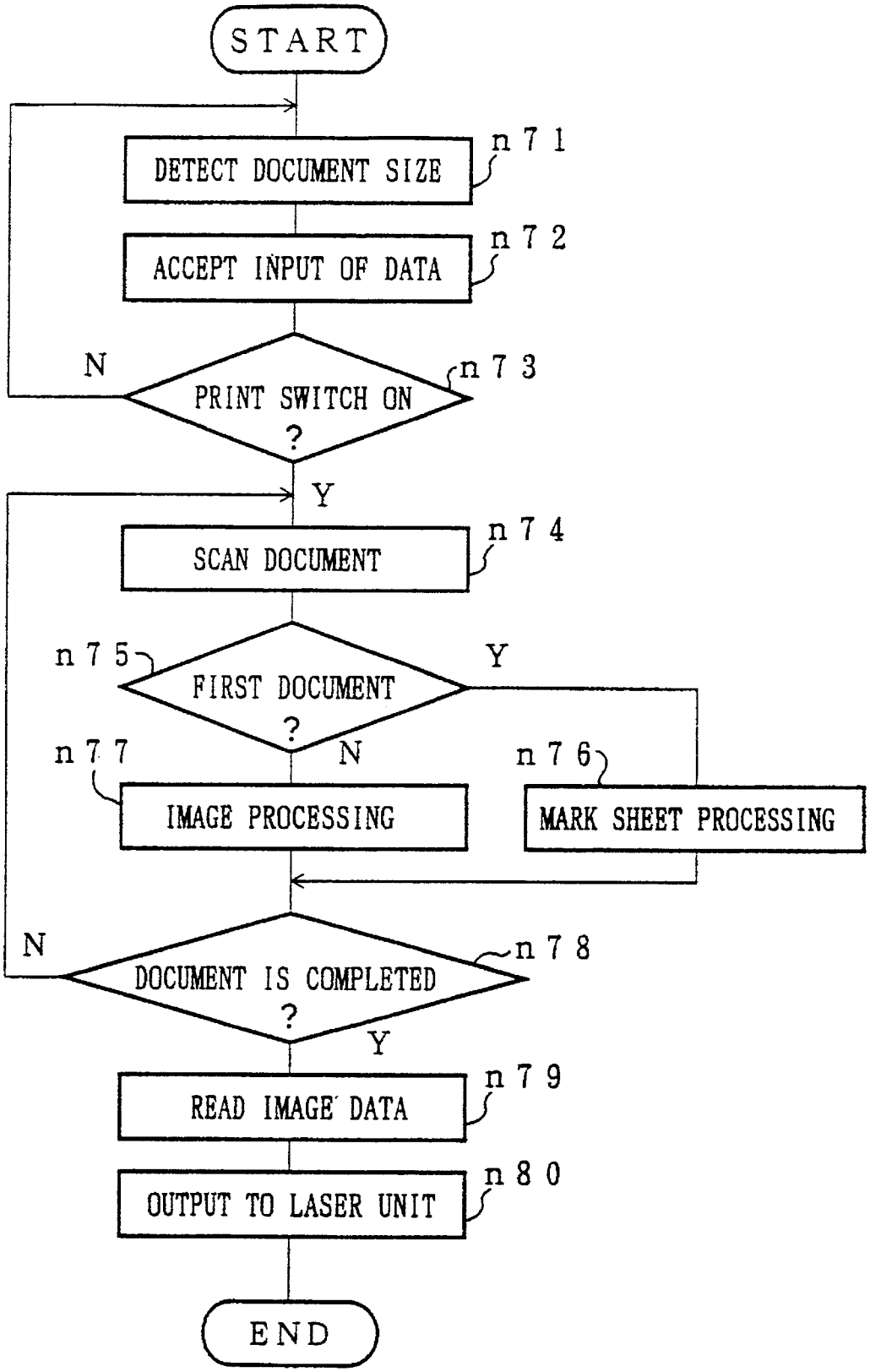
FIG. 11 is a flow chart which shows a processing procedure for setting a staple position at the time of the stapling process in the double-sided image forming apparatus.
Figure 12:
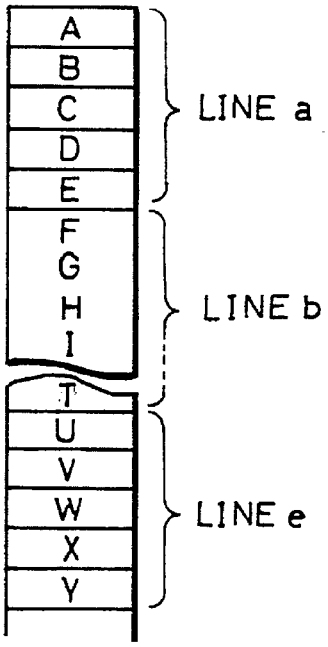
FIG. 12(A) is an explanatory drawing which shows image data which have been read by the double-sided image forming apparatus.
FIG. 12(B) is an explanatory drawing which shows a state that the image data in a state shown in FIG. 12(A) is rotated through an angle of 90°.
FIG. 12(C) is an explanatory drawing which shows a state that the image data in the state shown in FIG. 12(A) is rotated through an angle of 180°.
FIG. 12(D) is an explanatory drawing which shows a state that the image data in the state shown in FIG. 12(A) is rotated through an angle of 270°.
FIG. 12(E) is an explanatory drawing which shows a storing state of image data which have been read by the double-sided image forming apparatus in RAM shown in FIG. 6.

FIG. 11 is a flow chart which shows a processing procedure in the image forming apparatus in connection with setting of a stapling position at the time of the stapling process. When an operator sets a document on a document platen, a document size detecting unit is actuated so as to discriminate and detect a document size (n71). Successively, the image forming apparatus accepts input of various data, such as a copying magnification, a sheet size, copying density, a number of copies by an operator (n72) and waits for operation of a print switch (n73). When the print switch is operated, a document image is scanned by the optical unit 2 (n74), and the document is read by the CCD. Image data of the read document are binarized in the image data input section 115 and are temporarily stored in the RAM 113. A judgement is made whether the document is a first document or not therein (n75). When the document is a first document, it is judged that the document is a mark sheet which shows the stapling position, and a position of the mark is detected by regionally processing the image data stored in the RAM 113 so that the position where the stapling process is performed is determined (n76).

When the document is not a first document, the image data stored in the RAM 113 are processed in the image processing section 116 (n77). The sequences n74 through n77 are repeated until the documents are completed (n78). At the same time, an image forming direction of the sheet is judged based upon a positional relationship to the stapler 29, and if rotation of the image data is required, a rotating process is performed. As shown in FIG. 12(E), the image data are stored in the RAM 113 per bit, and the image data of the document, which have been read as shown in FIG. 12(A), are rotated through angles of 90° to 270° as shown in FIGS. 12(B) through 12(D). In the case where the rotation of the data is required in this way, the image data are successively read out from the RAM 113 in an order that the image data correspond to the angle of rotation (n79) and are supplied to the laser unit 13 (n80).

Figure 13A:
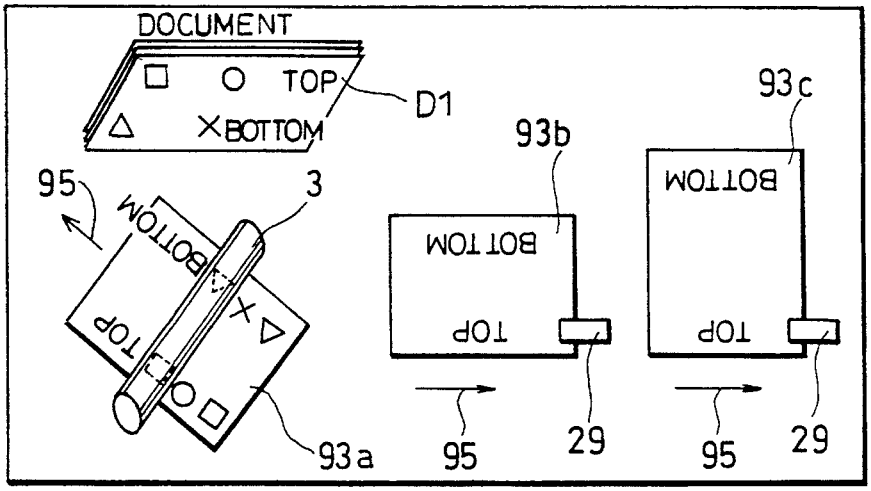
FIG. 13(A) is an explanatory drawing of a stapling process in the case where an image is formed with an up-and-down direction of a document intersecting perpendicularly to a sheet transporting direction in the double-sided image forming apparatus.
Figure 13B:
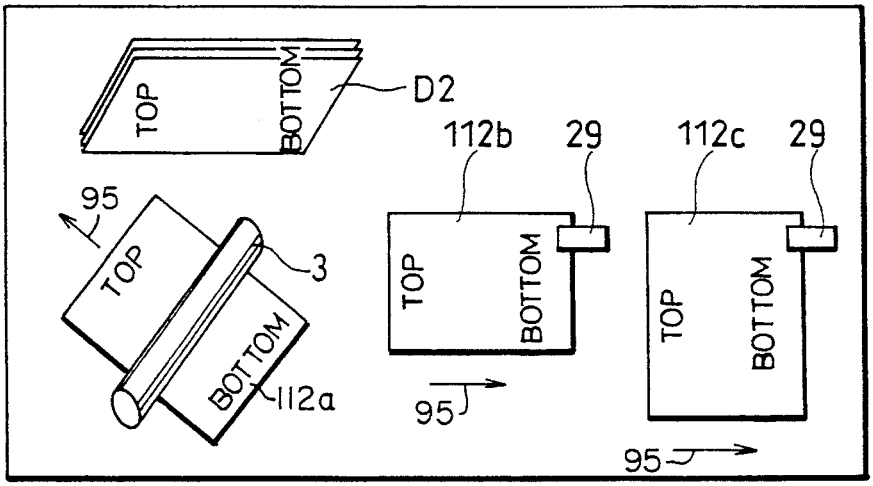
FIG. 13(B) is an explanatory drawing in the case where the stapling process is faulty when an image is formed with an up-and-down direction of a document being coincide with the sheet transporting direction in the double-sided image forming apparatus.
Figure 13C:
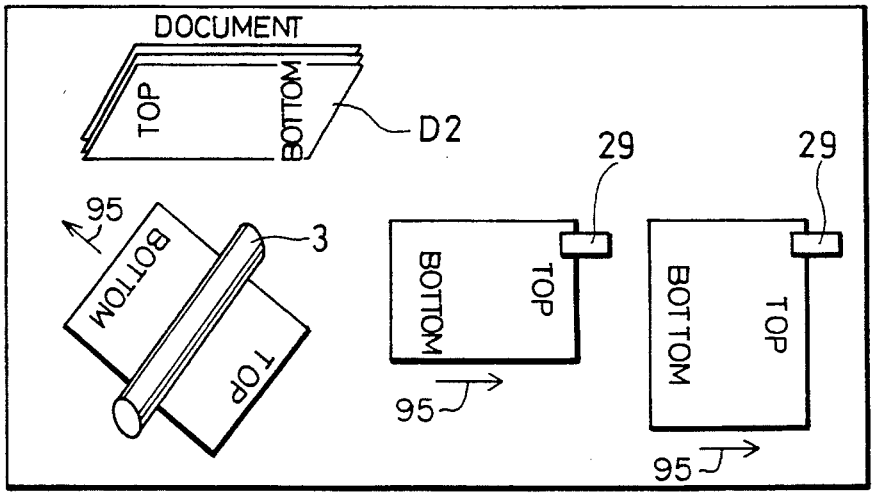
FIG. 13(C) is an explanatory drawing which shows an excellent stapling process in the case of FIG. 13(B).

For example, as shown in FIG. 13(A), in the case where the image forming process is performed with a top-and-bottom direction of a document D1 made coincide with the direction which intersects perpendicularly the sheet transporting direction 95 of a sheet 93*a* after the top and bottom of the sheet transporting direction 95 of sheet 93*a* is reversed in the second transport path 17 when the sheet is stored in the fourth transport path 19, as represented by sheets 93*b* and 93*c*, the stapling process can be performed on a proper position by moving the stapler 29 in the direction which intersects perpendicularly the transporting direction 95. Meanwhile, as shown in FIG. 13(B), in the case where the image forming is carried out with the top-and-bottom direction of a document D2 made coincide with the sheet transporting direction 95 of sheet 112*a*. After the top and bottom transporting directions 95 of the sheet are reversed in the second transport path, the sheet is transported to the fourth transport path 19, as represented by sheets 112(*b*) and 112*c*. The stapler 29 is counter to the lower side of the sheets, so a proper position cannot be subject to the stapling process. Therefore, as shown in FIG. 13(C), when the image data are rotated through an angle of 180° at the time of forming the image and are supplied to the laser unit 13, the upper side of the sheets can be counter to the stapler 29 in the fourth transport path 19, so the stapling process can be performed on a prescribed position.

Figure 14:
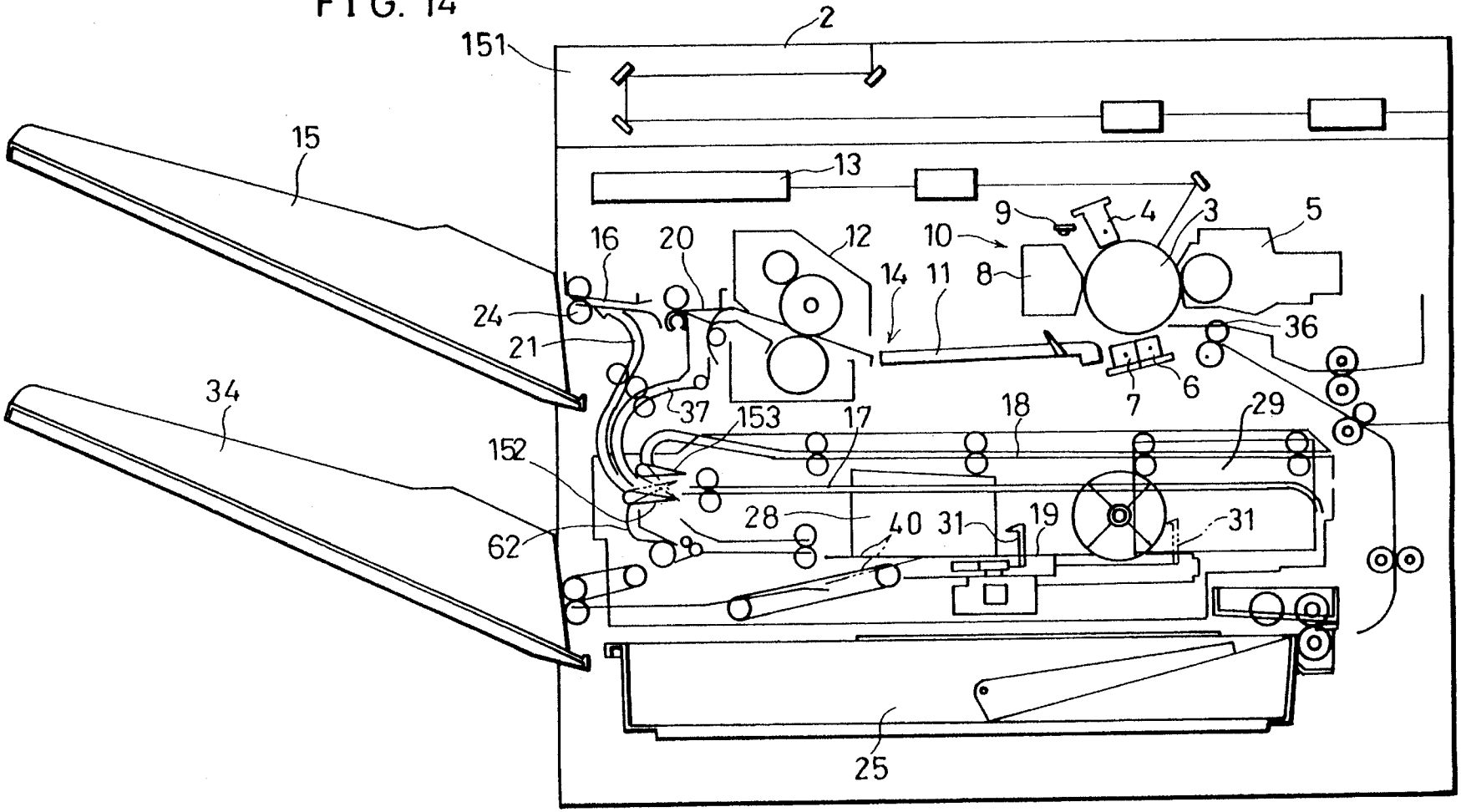
FIG. 14 is a front view which shows an internal structure of a double-sided image forming apparatus of another embodiment according to the present invention.
Figure 15:
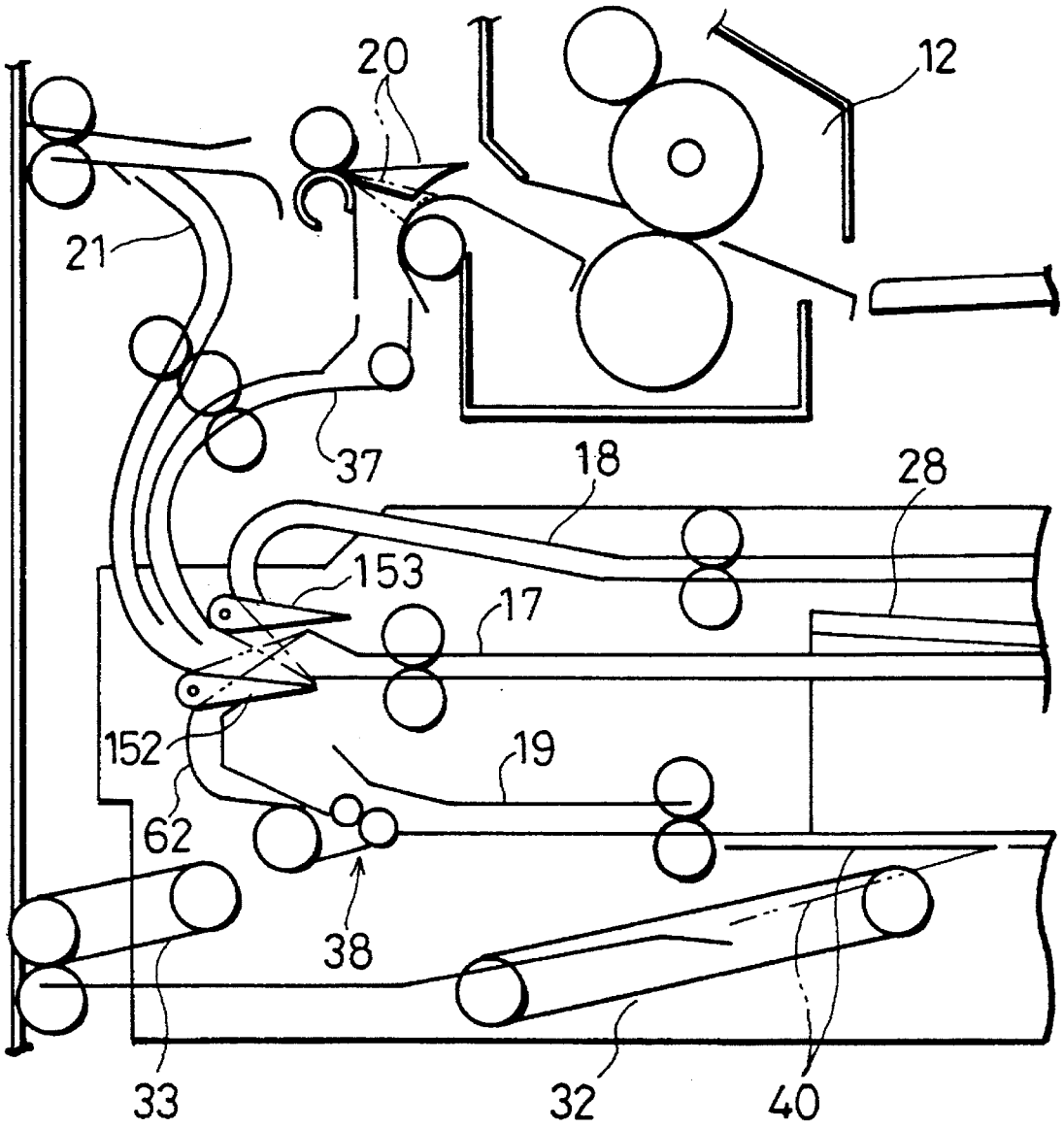
FIG. 15 is an enlarged drawing which shows a main section of the double-sided image forming apparatus shown in FIG. 14.

The following will discuss still another embodiment of the present invention referring to FIGS. 14 through 18. FIG. 14 is a drawing which shows an arrangement of an image forming apparatus 151 of another embodiment of the present invention. Moreover, an enlarged drawing of a main section of the image forming apparatus 151 is shown in FIG. 15. In the image forming apparatus 151, transport paths are arranged so as to include a third transport path 18, a second transport path 17 and a fourth transport path 19 in this order from the top between a first transport path 14 and a sheet cassette 25. When the transport paths are arranged in such a way, a jogger 28 for adjusting a direction which intersects perpendicularly a sheet transporting direction in the second transport path 17 and the fourth transport path 19 is not counter to the third transport path 18 which does not require adjusting. Therefore, a dimension of the jogger 28 in its up-and-down direction can be reduced. As a result, the jogger 28 can be miniaturized. Moreover, the jogger 28 can be actuated at arbitrary timing regardless of timing that sheets in the third transport path 18 pass. Therefore, the jogger 28 can be easily controlled.

On the contrary, a passage 62 as a second connecting passage, which connects the second transport path 17 and the fourth transport path 19, has a smaller radius of curvature compared to the passage 61, as shown in FIG. 2, in the case where the second transport path 17, the third transport path 18 and the fourth transport path 19 are laminated in this order from the top so as to be arranged. The sheets discharged from the second transport path 17 are curled depending upon a size of the radius of curvature of the passages 61 and 62, so the size of the radius of curvature affects sheet storing facility in the fourth transport path 19. Therefore, as shown in FIG. 2, from a viewpoint of the sheet storing facility in the fourth transport path 19, it is desirable that the passage 61 is arranged so as to have a larger radius of curvature.

In the image forming apparatus 151, a flapper 152 as second guiding means is provided between sheet insertion/discharge openings of a face down transport path 21 and the second transport path 17, and a flapper 153 as third guiding means is provided between a sheet insertion/discharge opening of the second transport path 17 and a sheet insertion opening of the third transport path 18. The flapper 152 leads sheets, which are discharged from the first transport path 14 and are transported through a passage 37, to the second transport path 17. Moreover, the flapper 152 leads sheets, which are discharged from the second transport path 17, towards the face down transport path 21 or the fourth transport path 19. Furthermore, the flapper 153 leads the sheets, which are discharged from the second transport path 17, to the third transport path 18. The flappers 152 and 153 are driven by a solenoid which is connected to a solenoid driver 103 in the same manner as of the aforementioned flappers 22 and 42.

In the image forming apparatus 151, an image forming operation is performed through the following procedure.

In the one-sided image forming mode which does not perform the stapling process, the process is performed through the procedure shown in FIG. 7 in the same manner as of the aforementioned image forming apparatus 1.

Figure 16:
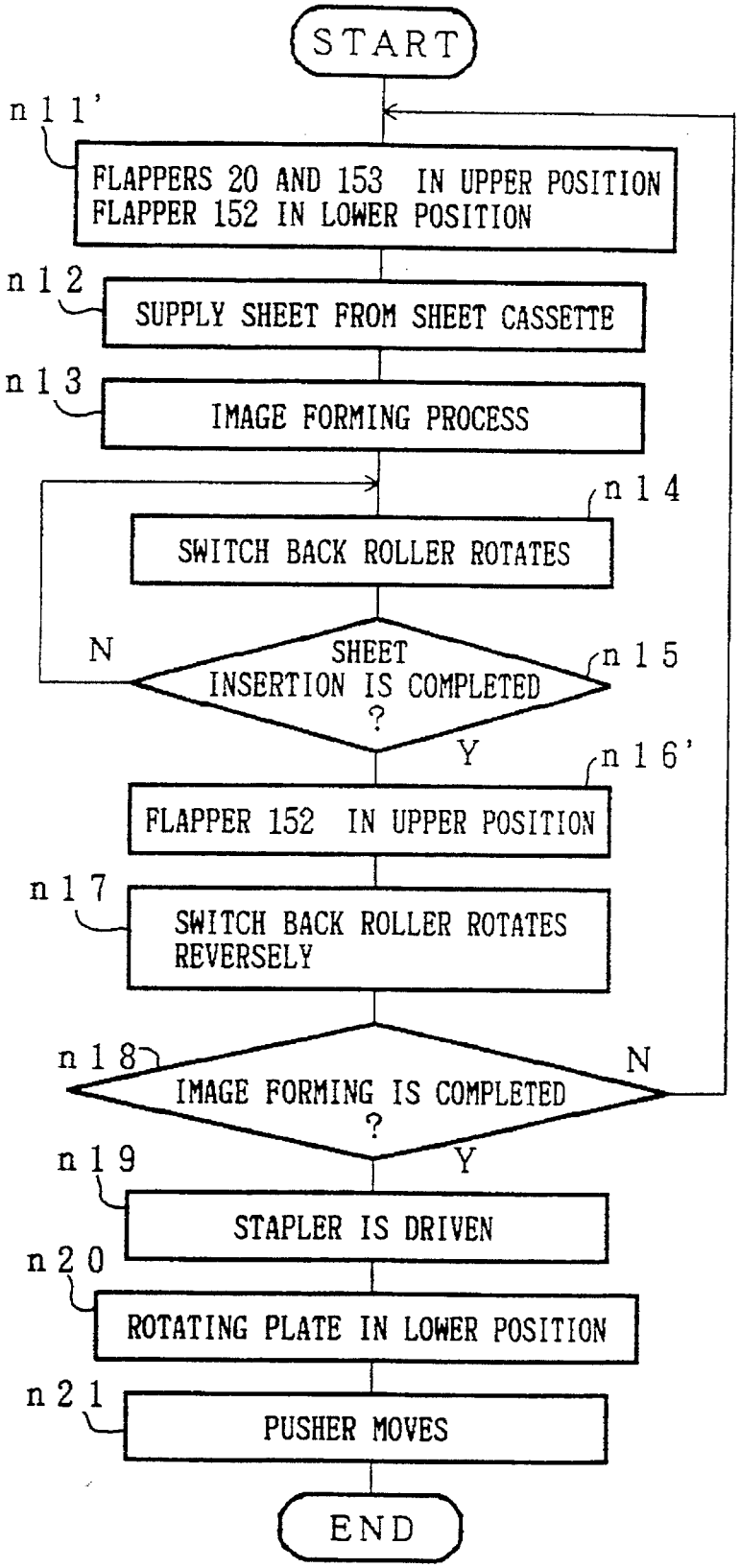
FIG. 16 is a flow chart which shows a processing procedure in a one-sided image forming mode which performs a stapling process in the double-sided image forming apparatus shown in FIG. 14.

In the one-sided image forming mode which performs the stapling process, the process is performed through the procedure shown in FIG. 16. A different point between the above processing procedure and the processing procedure in the image forming apparatus 1 shown in FIG. 8 is that the flapper 20 and the flapper 153 are upward and the flapper 152 is downward at n11'. Moreover, the other different point is that the flapper 152 moves upward at n16'.

Figure 17:
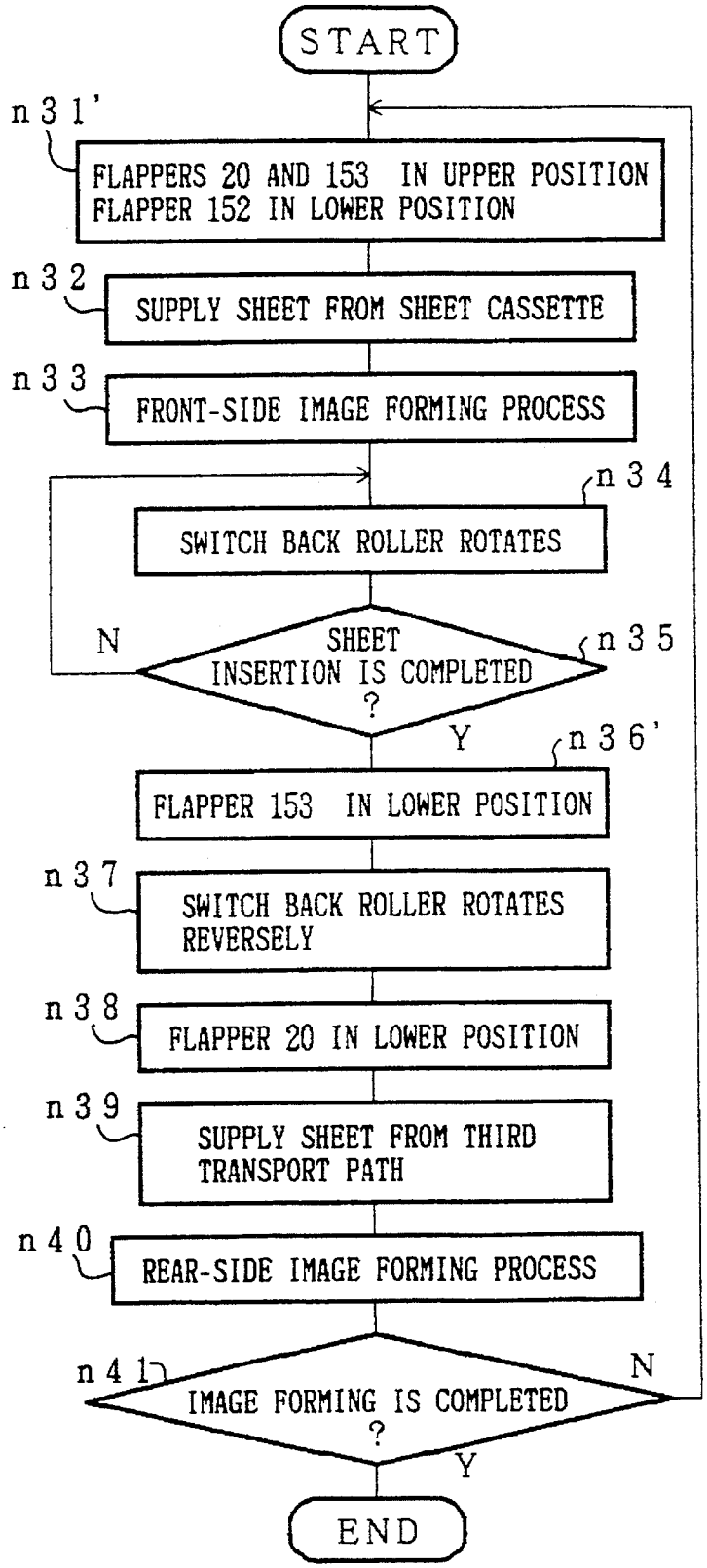
FIG. 17 is a flow chart which shows a processing procedure in a double-sided image forming mode which does not perform the stapling process in the double-sided image forming apparatus shown in FIG. 14.

In the both-side image forming mode which does not perform the stapling process, the process is performed through the procedure shown in FIG. 17. A different point between the above processing procedure and the processing procedure in the image forming apparatus 1 shown in FIG. 9 is that the flapper 20 and the flapper 153 are upward and the flapper 152 is downward at n31'. Moreover the other different point is that the flapper 153 moves downward at n36'.

In the double-sided image forming mode accompanying the stapling process, the process is performed through the procedure shown in FIG. 18. A different point between the above processing procedure and the processing procedure in the image forming apparatus 1 shown in FIG. 10 is that the flapper 20 and the flapper 153 are upward and the flapper 152 is downward at n51'. Moreover, another different point is that the flapper 153 moves downward at n56', and the flapper 20 and the flapper 153 are upward and the flapper 152 is downward at n58'. Moreover, another different point is that the flappers 152 and 153 move upward at n63'.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A double-sided image forming apparatus having a post-processing function, comprising:

a sheet storing section for storing and feeding sheets;

an image forming section for forming an image on sheets;

a feed transport path which extends from said sheet storing section to said image forming section;

a first discharge section for discharging sheets out of the apparatus, said first discharge section being opened on one side of the double-sided image forming apparatus;

a second discharge section for discharging sheets out of the apparatus, said second discharge section being opened on the same side where said first discharge section is formed;

a first transport path which extends from said image forming section to said first discharge section;

a second transport path for reversing a front and rear of a sheet transporting direction, said second transport path including a sheet insertion/discharge opening connected to a first discharge section side of the first transport path;

a third transport path having a sheet insertion opening and a sheet discharge opening, said sheet insertion opening being connected to said sheet insertion/discharge opening of said second transport path, said sheet discharge opening being connected to said feed transport path;

a fourth transport path having a sheet insertion opening and a sheet discharge opening, said sheet insertion opening being connected to said sheet insertion/discharge opening of said second transport path, said sheet discharge opening being connected to said second discharge section;

an adjusting means for adjusting sheets transported to said fourth transport path and sheets transported to said second transport path to a prescribed position; and post-processing means for performing a post-process on image formed sheets which have been transported to said fourth transport path and have been adjusted by said adjusting means.

2. The double-sided image forming apparatus having a post-processing function as defined in claim 1, wherein said second through fourth transport paths are formed so as to extend in a same direction.

3. The double-sided image forming apparatus having a post-processing function as defined in claim 1, wherein:

said first through fourth transport paths are positioned such that said first transport path, said second transport path, said third transport path and said fourth transport path are laminated in this order from the top, said second discharge section is positioned below said first discharge section.

4. The double-sided image forming apparatus having a post-processing function as defined in claim 3, wherein:

said sheet insertion/discharge opening of said second transport path is connected to a first discharge section side of said first transport path through a first connecting passage, said sheet insertion opening of said third transport path and said sheet insertion opening of said fourth transport path are connected to said sheet insertion/discharge opening of said second transport path through a second connecting passage, said double-sided image forming apparatus further comprising:

first guiding means for switching between a state that sheets to be transported from said first transport path are guided towards said first discharge section and a state that the sheets are guided toward said first connecting passage;

second guiding means for switching between a state that the sheets which have passed through said first connecting passage are guided to said second transport path and a state that the sheets discharged from said second transport path are guided to the second connecting passage;

third guiding means for switching between a state that the sheets which have passed through said second connecting passage are guided to said third transport path and a state that the sheets are guided to said fourth transport path, and said first through said third guiding means being respectively provided between said first transport path and said fourth transport path.

5. The double-sided image forming apparatus having a post-processing function as defined in claim 4, further comprising:

a fifth transport path which extends from said sheet insertion/discharge opening of said second transport path to said first discharge section, wherein when said second guiding means guides the sheets which have passed through said first connecting passage to the second transport path, the sheets to be discharged from said second transport path are guided to said fifth transport path.

6. The double-sided image forming apparatus having a post-processing function as defined in claim 1, wherein:

said first through fourth transport paths are positioned such that said first transport path, said third transport path, said second transport path and said fourth transport path are laminated in this order from the top, said second discharge section is positioned below said first discharge section.

7. The double-sided image forming apparatus having a post-processing function as defined in claim 6, wherein:

said sheet insertion/discharge opening of said second transport path is connected to a first discharge section side of said first transport path through a first connecting passage, said sheet insertion opening of said fourth transport path is connected to said sheet insertion/discharge opening of said second transport path through a second connecting passage, said double-sided image forming apparatus further comprising:

first guiding means for switching between a state that sheets to be transported from said first transport path are guided towards said first discharge section and a state that the sheets are guided toward said first connecting passage;

second guiding means for switching between a state that the sheets which have passed through said first connecting passage are guided to said second transport path and a state that the sheets to be discharged from said second transport path are guided to said fourth transport path;

third guiding means for guiding the sheets to be discharged from said second transport path to said third transport path, and said first through said third guiding means being respectively provided between said first transport path and said fourth transport path.

8. The double-sided image forming apparatus having a post-processing function as defined in claim 7, further comprising:

a fifth transport path which extends from said sheet insertion/discharge opening of said second transport path to said first discharge section, wherein when said second guiding means guides the sheets through said first connecting passage to said second transport path and when said third guiding means opens a passage between said second transport path and said fifth transport path at the same time, the sheets to be discharged from said second transport path are guided to said fifth transport path.

9. The double-sided image forming apparatus having a post-processing function as defined in claim 1, wherein:

said sheet storing section is provided below said first transport path, said second through fourth transport paths are provided between said first transport path and said sheet storing section.

10. The double-sided image forming apparatus having a post-processing function as defined in claim 1, wherein said fourth transport path is provided with said sheet insertion opening and said sheet discharge opening on a same direction side in an extended direction from said fourth transport path, said fourth transport path being provided with a rocking member in a midway position between said sheet insertion opening and a position where the post-process is performed by post-processing means, said rocking member selectively connecting the midway position to said sheet insertion opening or said sheet discharge opening.

11. The double-sided image forming apparatus having a post-processing function as defined in claim 10, wherein:

said sheet insertion opening of said fourth transport path is provided in an upper position with respect to said sheet discharge opening and said second discharge section, said rocking member rotates in top-to-bottom direction centered on a side of the position where the post-process is performed.

12. The double-sided image forming apparatus having a post-processing function as defined in claim 1, wherein said adjusting means has an adjusting member which moves in a direction perpendicularly intersecting a sheet transporting direction and which pushes a sheet side end section, said adjusting member being provided in said second transport path and fourth transport path, said adjusting member in said both transport paths being connected to each other so as to move together.

13. The double-sided image forming apparatus having a post-processing function as defined in claim 1, further comprising a fifth transport path which extends from said sheet insertion/discharge opening of said second transport path to said first discharge section.

14. The double-sided image forming apparatus having a post-processing function as defined in claim 1, wherein said second through fourth transport paths are provided so as to be detachable together by moving the apparatus in a front-and-rear direction of the apparatus.

* * * * *